US005818482A

United States Patent [19]

Ohta et al.

[11] Patent Number: 5,818,482

[45] Date of Patent: Oct. 6, 1998

[54] INK JET PRINTING HEAD

[75] Inventors: Yoshihisa Ohta, Machida; Shuzo Matsumoto, Yokohama; Taeko Murai, Yokohama; Hideyuki Makita, Yokohama; Tsutomu Sasaki, Yokohama; Tetsuro Hirota, Hadano; Osamu Naruse, Yokohama; Michio Umezawa; Masayuki Iwase, both of Kawasaki, all of Japan

[73] Assignee: Ricoh Company, Ltd., Tokyo, Japan

[21] Appl. No.: 517,719

[22] Filed: Aug. 21, 1995

[30] Foreign Application Priority Data

| | | | |
|---|---|---|---|
| Aug. 22, 1994 | [JP] | Japan | 6-196983 |
| Sep. 9, 1994 | [JP] | Japan | 6-216112 |
| Oct. 12, 1994 | [JP] | Japan | 6-246623 |
| Oct. 12, 1994 | [JP] | Japan | 6-246624 |
| Dec. 2, 1994 | [JP] | Japan | 6-299842 |
| Jul. 18, 1995 | [JP] | Japan | 7-181238 |

[51] Int. Cl.[6] ..... B41J 2/045

[52] U.S. Cl. ..... 347/70; 347/40

[58] Field of Search ..... 347/40, 70, 71

[56] References Cited

U.S. PATENT DOCUMENTS

| | | | |
|---|---|---|---|
| 5,144,342 | 9/1992 | Kubota | 346/140 R |
| 5,453,707 | 9/1995 | Chang et al. | 347/10 |

FOREIGN PATENT DOCUMENTS

| | | |
|---|---|---|
| 60-8953 | 3/1985 | Japan . |
| 61-59913 | 12/1986 | Japan . |
| 3-10846 | 1/1991 | Japan . |
| 4-1052 | 1/1992 | Japan . |
| 4-16353 | 1/1992 | Japan . |

*Primary Examiner*—Daniel P. Malley

*Attorney, Agent, or Firm*—Oblon, Spivak, McClelland, Maier & Neustadt, P.C.

[57] ABSTRACT

An ink jet printing head includes: a plurality of piezoelectric actuators arranged in rows on a substrate, each row including first piezoelectric elements and second piezoelectric elements which are alternately arrayed along the row, the first piezoelectric elements being actuatable to apply a compressive force to ink in accordance with print signals, the second piezoelectric elements being fixed and not actuated; and an ink chamber unit which includes ink chambers located above the first piezoelectric elements and containing ink. The ink chamber unit includes: an oscillation plate including diaphragm portions which are connected to the first piezoelectric elements and independently deformable in a direction perpendicular to the substrate by the first piezoelectric elements when actuated; and a nozzle plate which includes nozzles being located above the diaphragm portions and opened to the ink chambers, so that ink drops are respectively forced out from the nozzles when the first piezoelectric elements are actuated.

30 Claims, 21 Drawing Sheets

INK JET PRINTING HEAD

BACKGROUND OF THE INVENTION

The present invention generally relates to an ink jet printing head, and more particularly to an on-demand ink jet printing head which forces out ink drops from nozzles in accordance with print signals by pressurizing ink within ink chambers through actuation of multilayer piezoelectric elements.

Ink jet printing attracts a special attention because it is capable of printing an image on plain paper without contacting a printing head with the paper. Generally, an ink jet printer system uses a simple printing process, and it can be suitably applied to color image printing. Thus, the ink jet printer system is taken as being advantageous over the other printing systems.

In recent years, an on-demand ink jet printer system has become the main trend among various types of ink jet printer systems. The on-demand type ink jet printing head sends out a drop of ink to the paper in accordance with a print signal when received.

There are two major types of the on-demand ink jet printer systems: a bubble jet type and a piezoelectric actuation type.

Japanese Published Patent Application No.61-59913 discloses a bubble jet printing head. The bubble jet printing head utilizes thermal energy to generate bubbles in ink and send out ink drops from nozzles.

The bubble jet printing head, disclosed in the above publication, includes thermoelectric heating elements arranged in an ink passage, and nozzles opened to the ink passage. The ink within the ink passage is heated by the heating elements to generate bubbles in the ink passage. The pressure of the ink is increased by the bubbles generated in the ink passage, thereby ink drops emerging from the nozzles.

The bubble jet printing head is advantageous in that the high-density integration of printing head components and the miniaturization are easily practical because the heating elements are very small in size.

However, the bubble jet printing head has a problem that the repetition frequency of print signals applied to the printing head must be low enough to prevent the increasing of the substrate temperature when heated. Also, the bubble jet printing head has a problem that the kinds of ink suitable for use with the printing head are limited since the ink is directly heated by the heating elements in the ink passage.

Japanese Published Patent Application No. 60-8953 discloses a piezoelectric actuation type ink jet printing head. In the disclosed printing head, nozzles are formed on the end surface of an ink chamber unit, and piezoelectric materials are arranged in the ink chamber. The piezoelectric materials are actuated to pressurize the ink within the ink chamber and send out ink drops from the nozzles.

In the printing head of the type disclosed in the above-mentioned publication, the piezoelectric elements are arranged in the ink chamber, and they are brought into contact with the ink.

Further, Japanese Laid-Open Patent Application No. 3-10846 discloses another piezoelectric actuation ink jet printing head. In this printing head, a glass plate which forms an upper wall of an ink chamber is provided, and piezoelectric materials are arranged on the outside surface of the glass plate. The piezoelectric materials are actuated to deform the glass plate, or depress the upper wall of the ink chamber, to pressurize the ink contained in the ink chamber and emerge ink drops from the nozzles on the side end surface of the ink chamber.

In the ink jet printing head of the above type, disclosed in the above-mentioned publication, the piezoelectric elements are arranged on the top of the glass plate which forms the upper wall of the ink chamber. The piezoelectric elements do not directly contact the ink in the ink chamber. An increase of the temperature of the heated piezoelectric materials may be eliminated. The kinds of ink suitable for use with the printing head are not limited.

However, the piezoelectric actuation ink jet printing head of the above type is difficult to avoid the interference between ink chambers when discharging ink from the multi-nozzle printing head wherein the nozzles, the piezoelectric actuators, and the ink chambers are arranged. The above multi-nozzle printing head is likely to experience the interference of the piezoelectric actuation of the adjacent actuators and the interference of the ink discharging of the adjacent ink chambers.

Japanese Laid-Open Patent Application No. 4-16353 discloses a multi-nozzle ink jet printing head of the above type. In this printing head, piezoelectric actuators are arranged in two tows on the substrate. The actuators of each row include actuatable piezoelectric elements and fixing piezoelectric elements, and they are alternately arrayed along the row. The actuatable piezoelectric elements are actuated to generate mechanical stress in accordance with print signals. No print signals are supplied to the fixing piezoelectric elements, and they are not actuated.

In the printing head disclosed in the above publication, an ink chamber block is arranged on the actuators, and a bottom surface of the ink chamber block forms an oscillation plate. This ink chamber block includes two ink chambers which communicate with each other and are respectively located above the actuators via the oscillation plate. When the actuatable piezoelectric elements are actuated, the deformation of the actuatable piezoelectric elements due to the mechanical stress is transmitted to ink in the ink chambers via the oscillation plate, so that ink drops are discharged from the nozzles.

The above multi-nozzle printing head utilizes the deformations by the piezoelectric elements being actuated, in order to discharge ink drops. When ink drops are discharged by the multi-nozzle printing head, the deformations of adjacent piezoelectric elements interfere with each other through the oscillation plate. This causes the ink discharging operations of the nozzles to be inefficient.

In order to realize equal ink discharging operations of the nozzles of the multi-nozzle structure printing head upon high-speed printing, it is necessary to eliminate the interference of the deformations of the adjacent piezoelectric elements and the interference of the ink discharging operations of the adjacent nozzles. However, the above-mentioned printing head is insufficient to realize equal ink discharging operations of the nozzles upon high-speed printing, and it is difficult to realize an efficient ink discharging operation and a high-frequency actuation of the piezoelectric elements for the high-speed printing.

SUMMARY OF THE INVENTION

An object of the present invention is to provide an improved, multi-nozzle ink jet printing head in which the above-described problems are eliminated.

Another object of the present invention is to provide a multi-nozzle ink jet printing head which increases an efficiency of ink discharging from nozzles without producing the interference of adjacent ink chambers and realizes a high-frequency piezoelectric actuation needed for the practical use.

The above-mentioned objects of the present invention are achieved by an ink jet printing head which includes: a plurality of piezoelectric actuators arranged in rows on a substrate, each row including first piezoelectric elements and second piezoelectric elements which are alternately arrayed along the row, the first piezoelectric elements being actuatable to apply a compressive force to the ink in accordance with print signals, the second piezoelectric elements being fixed and not actuated; and an ink chamber unit, arranged on the actuators, which includes ink chambers located above the respective first piezoelectric elements, the respective ink chambers containing ink. This ink chamber unit comprises: an oscillation plate including diaphragm portions which are connected to the respective first piezoelectric elements and independently deformable in a vertical direction perpendicular to the substrate by the first piezoelectric elements when actuated; and a nozzle plate which includes nozzles located above the respective diaphragm portions and opened to the ink chambers, so that ink drops are respectively forced out from the nozzles when the first piezoelectric elements are actuated.

The above-mentioned objects of the present invention are also achieved by an ink jet printing head which includes: a plurality of piezoelectric actuators arranged in rows on a substrate, each row including first piezoelectric elements and second piezoelectric elements which are alternately arrayed along the row, the first piezoelectric elements being actuatable to stress ink in accordance with print signals, the second piezoelectric elements being fixed and not actuated; and an ink chamber unit, arranged on the actuators, which includes ink chambers located above the respective first piezoelectric elements, wherein the respective ink chambers contain ink. This ink chamber unit comprises: an oscillation plate including diaphragm portions which are connected to the respective first piezoelectric elements and independently deformable in a vertical direction perpendicular to the substrate by the first piezoelectric elements when actuated; a nozzle plate which includes nozzles located above the respective diaphragm portions and opened to the ink chambers, so that ink drops are respectively forced out from the nozzles when the first piezoelectric elements are actuated; and an ink passage member, arranged between the oscillation plate and the nozzle plate, which includes ink passages communicating with the respective ink chambers, the ink passages having a shape corresponding to a shape of the diaphragm portions.

According to the present invention, it is possible to increase the efficiency of the ink discharging of the multi-nozzle ink jet printing head by minimizing the interference between the ink chambers. Also, it is possible to make the multi-nozzle ink jet printing head efficient to perform a high-frequency piezoelectric actuation with equal ink discharging operations of the ink chambers.

BRIEF DESCRIPTION OF THE DRAWINGS

Other objects, features and advantages of the present invention will be more apparent from the following detailed description when read in conjunction with the accompanying drawings in which.

DESCRIPTION OF THE PREFERRED EMBODIMENTS

A description will now be given of an ink jet printing head in one embodiment of the present invention.

Figure 1:
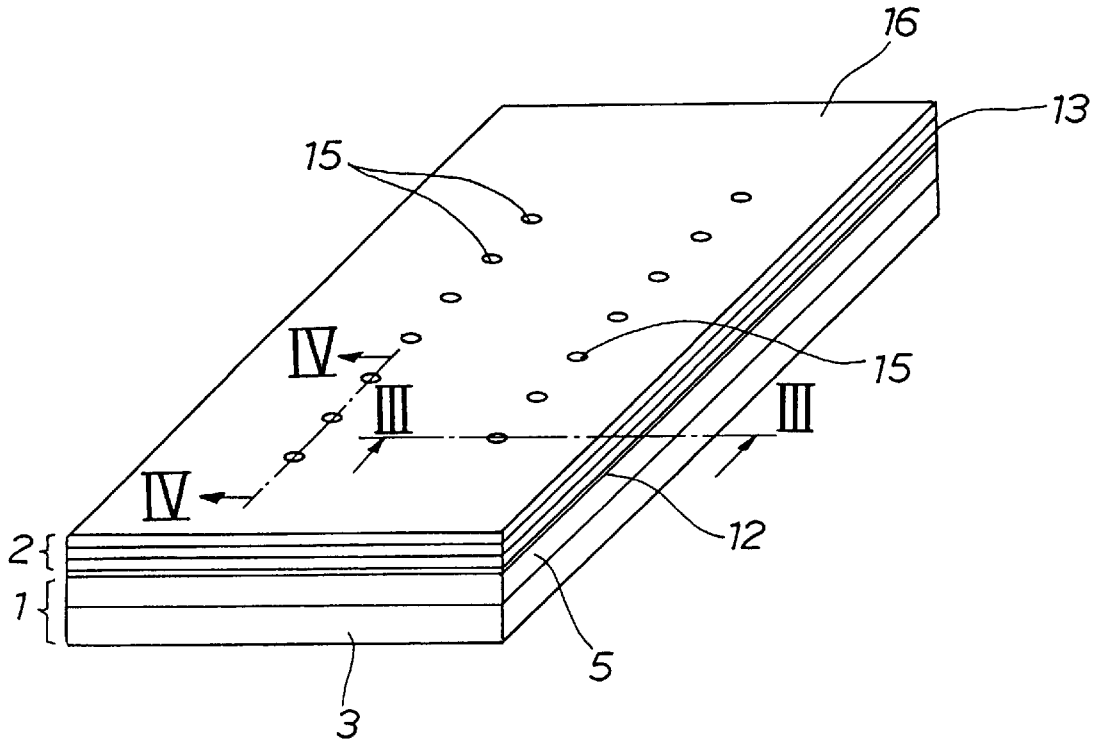
FIG. 1 is a perspective view of an ink jet printing head in one embodiment of the present invention.
Figure 2:
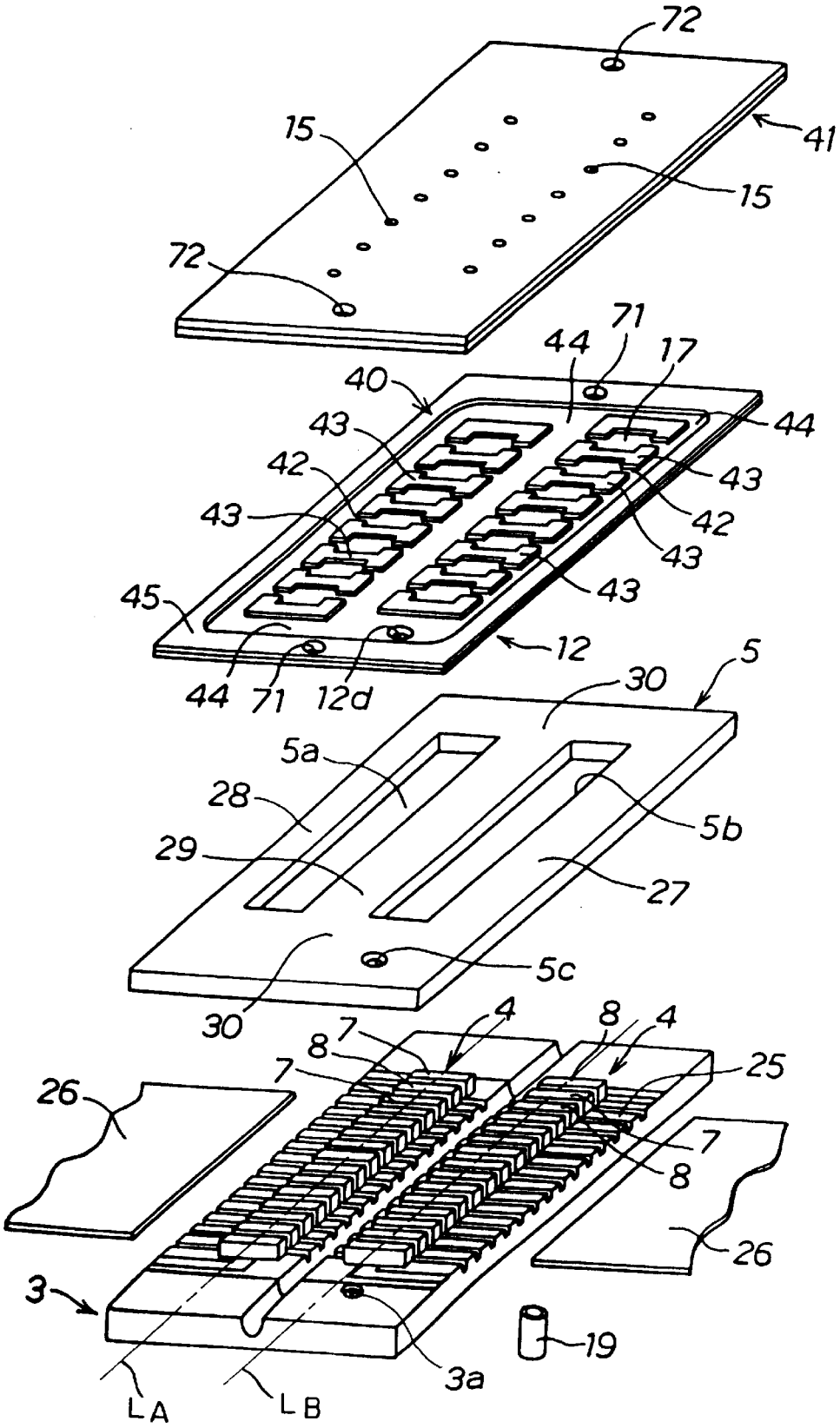
FIG. 2 is an exploded view of the ink jet printing head in FIG. 1.
Figure 3:
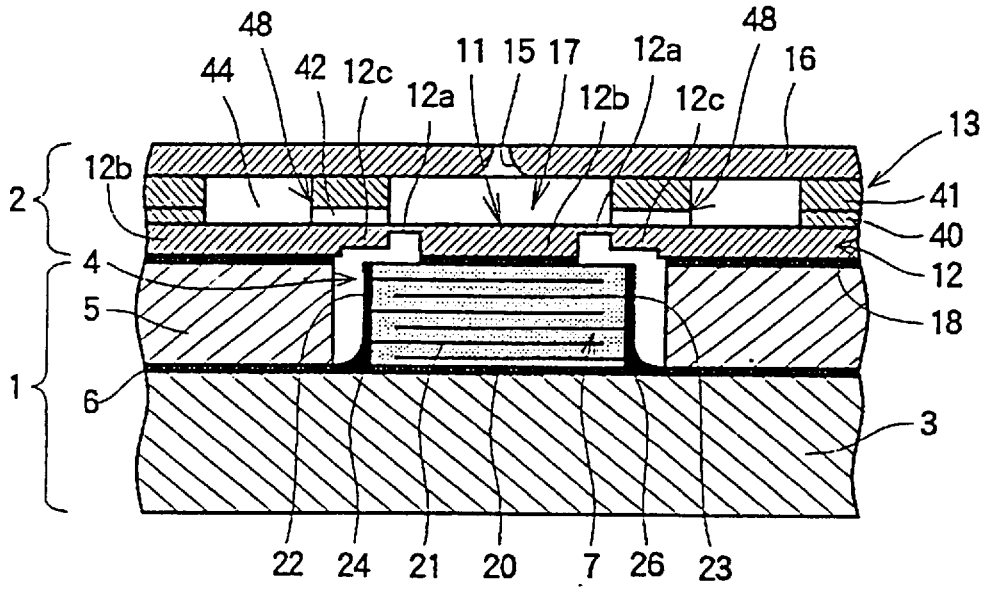
FIG. 3 is a cross-sectional view of the ink jet printing head taken along a line III—III in FIG. 1.
Figure 4:
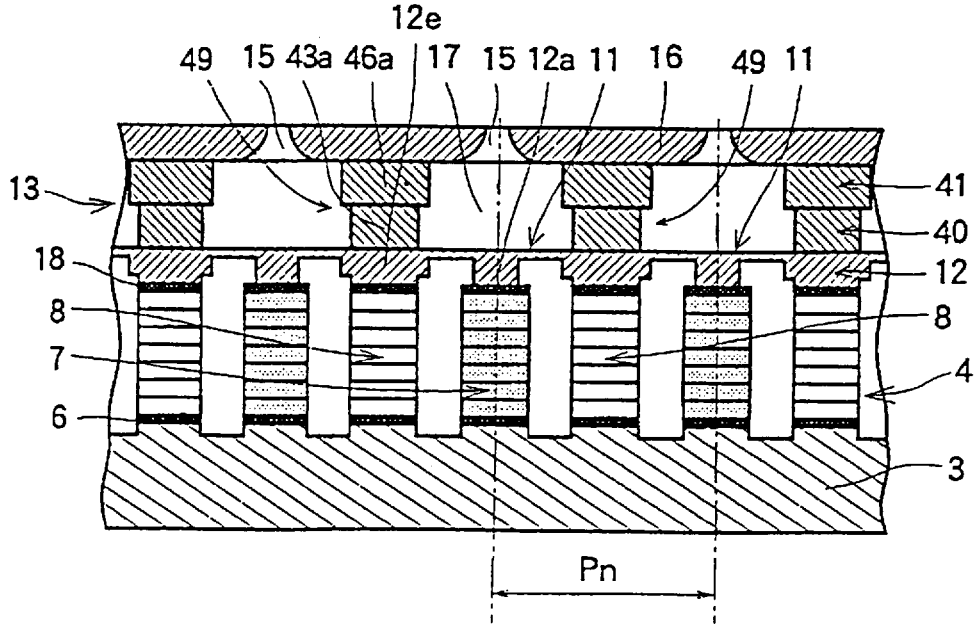
FIG. 4 is a cross-sectional view of the ink jet printing head taken along a line IV—IV in FIG. 1.

FIG. 1 shows an ink jet printing head in one embodiment of the present invention. FIG. 2 is an exploded view of this ink jet printing head. FIG. 3 shows a cross-section of the ink jet printing head taken along the line III—III in FIG. 1. FIG. 4 shows a cross-section of the ink jet printing head take along the line IV—IV in FIG. 1.

As shown in FIGS. 1 through 4, this ink jet printing head includes an actuator unit 1 and an ink chamber unit 2 bonded to the actuator unit 1.

The actuator unit 1 includes a substrate 3, two piezoelectric actuator rows 4, and a frame 5. The piezoelectric actuator rows 4 and the frame 5 are bonded to the substrate 3 by using an adhesive agent. A layer of this adhesive agent is designated by a reference numeral 6.

The frame 5 in this embodiment includes two longitudinally extending rectangular openings 5*a* and 5*b*, and the piezoelectric actuator rows 4 are respectively encircled by these openings 5*a* and 5*b* after the frame 5 is arranged on the substrate 3.

The piezoelectric actuators 4 of each row includes actuatable piezoelectric elements 7 and fixing piezoelectric elements 8. As shown in FIGS. 2 and 4, the actuatable piezoelectric elements 7 and the fixing piezoelectric elements 8 of each row are alternately arrayed on the substrate 3 along the row. Each actuatable piezoelectric element 7 is actuated to generate mechanical stress (in order to force ink drops out) in accordance with a print signal supplied by a print controller (not shown). The fixing piezoelectric elements 8 are not actuated and fixed to the substrate 3, and no print signals are supplied to the fixing piezoelectric elements 8. The fixing piezoelectric elements 8 serve to fix ink chambers 17 within the ink jet printing head.

The ink chamber unit 2 serves to form the ink chambers 17 within the ink jet printing head. The ink chamber unit 2 includes an oscillation plate 12, an ink passage member 13 bonded to the oscillation plate 12, and a nozzle plate 16 bonded to the ink passage member 13.

The oscillation plate 12 includes a plurality of diaphragm portions 11 which are independently subjected to deformation by the actuatable piezoelectric elements 7 when actuated in accordance with the print signals.

The ink passage member 13 is made of a photosensitive resin film (which is called also a dry film resist), and it forms ink passages 14 whose shape is the same as the shape of the diaphragm portions 11. The nozzle plate 16 includes a plurality of nozzles 15 which are located above the respective ink chambers 17.

The ink chambers 17 are constituted by the oscillation plate 12, the ink passage member 13, and the nozzle plate 16. The respective nozzles 15 are located above portions of the ink chambers 17 to which the actuatable piezoelectric elements 7 connected via the diaphragm portions 11.

The oscillation plate 12 of the ink chamber unit 2 is bonded to the actuator unit 1 by using an adhesive agent with a high rigidity. A layer of this adhesive agent is designated by a reference numeral 18.

The substrate 3 of the actuator unit 1 is about 0.5–5 mm thick. In this embodiment, the substrate 3 is made of a ceramic material. Preferably, the substrate 3 and the piezoelectric elements 7 and 8 are made of the same material, and they are easily cut by using a suitable cutting machine or ground by using a suitable grinding machine.

At an end portion of the substrate 3, an ink supply hole 3a is provided. An ink supply pipe 19 is inserted to this ink supply hole 3*a*, which is used to supply ink to the ink chambers 17.

Both the actuatable and fixing piezoelectric elements 7 and 8 of the piezoelectric actuator rows 4 have a multilayer structure including ten or more layers which are laminated in a laminating direction perpendicular to the substrate 3.

Each of the piezoelectric elements 7 and 8 in this embodiment is made of piezoelectric material layers 20 (which are, for example, $Pb(Zr{\cdot}Ti)O_3$) and internal electrodes 21 (which are, for example, AgPb), and the layers 20 and the electrodes 21 are alternately laminated, as shown in FIG. 3. The above piezoelectric material $Pb(Zr{\cdot}Ti)O_3$ is a highly rigid material with a Young's modulus on the order of several $10^3$ kg/mm$^2$.

In the above embodiment, each piezoelectric material layer 20 is about 20–50 microns ($\mu$m) thick, and the thickness of each internal electrode 21 is on the order of several microns.

As the piezoelectric elements in the above embodiment are formed into a multilayer structure, the drive voltage required to actuate the actuatable piezoelectric elements 7 is reduced to a relatively low voltage. In the above embodiment, an electric field in the magnitude of 1000 volts per millimeter is produced for each of the actuatable piezoelectric elements 7 when actuated. In accordance with the print signals, the actuatable piezoelectric elements 7 are actuated by drive pulses with the voltage of 20–50 volts, to generate deformation of the piezoelectric elements 7.

In addition, different piezoelectric materials, which are other than the above-mentioned piezoelectric material, may be used instead. Such examples of the piezoelectric materials are ferroelectric materials such as $BaTiO_3$, $PbTiO_3$, and (NaK) $NbO_3$.

As shown in FIGS. 2 and 3, the actuatable piezoelectric elements 7 include end-surface electrodes 22 and 23 (=AgPb), and the internal electrodes 21 are connected to these end-surface electrodes 22 and 23. An external electrode pattern 25, which is produced on the substrate 3 through deposition of Ni and Au, is connected to the electrodes 22 and 23 by using a conductive adhesive agent. A layer of the conductive adhesive agent is designated by a reference numeral 24 in FIG. 3.

A cable 26 is electrically connected to the external electrode pattern 25. The drive voltage (or the print signal) from the cable 26 is supplied to each of the actuatable piezoelectric elements 7 through the external electrode pattern 25. It produces an electric field in the laminating direction perpendicular to the substrate 3, thereby generating mechanical stress in the laminating direction in one of the actuatable piezoelectric elements 7.

The inward facing end-surface electrodes 22 of the actuatable piezoelectric elements 7 of the two rows 4 on the substrate 3 are called the individual drive electrodes. The outward facing end-surface electrodes 23 of the actuatable piezoelectric elements 7 of the two rows 4 are called the common electrodes.

The actuatable piezoelectric elements 7 and the fixing piezoelectric elements 8, included in the piezoelectric actuator rows 4, are formed through cutting of a single plate of a piezoelectric material. The structure to define how the actuatable piezoelectric elements 7 and the fixing piezoelectric elements 8 are arranged depends on a specific design of the ink jet printing head.

Figure 5:
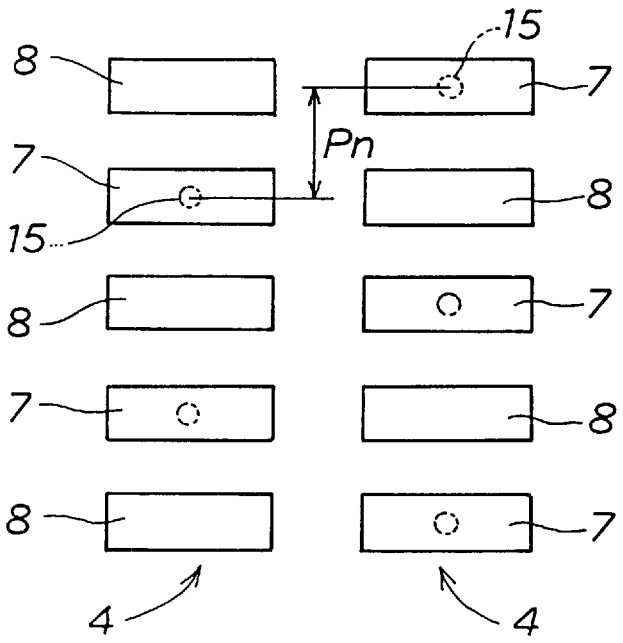
FIG. 5 is a diagram showing an arrangement of actuatable piezoelectric elements and fixing piezoelectric elements in each row.

FIG. 5 shows an arrangement of the actuatable piezoelectric elements 7 and the fixing piezoelectric elements 8 which are alternately arrayed. In this embodiment, the actuatable piezoelectric elements 7 of the two rows 4 and the fixing piezoelectric elements 8 of the two rows 4 are arrayed in a zigzag manner. In FIG. 5, a distance "Pn" between two adjacent actuatable piezoelectric elements 7 along the lines (indicated by one-dot chain lines "LA" and "LB" in FIG. 2) of the rows 4 of the piezoelectric actuators 4 is relatively small.

Figure 6:
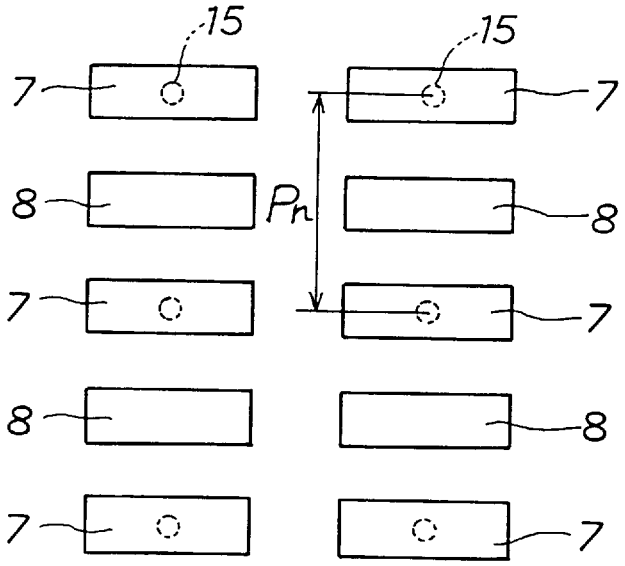
FIG. 6 is a diagram showing another arrangement of the actuatable piezoelectric elements and the fixing piezoelectric elements.

FIG. 6 shows another arrangement of the actuatable piezoelectric elements 7 and the fixing piezoelectric elements 8 which are alternately arrayed on each of the two rows 4. In this embodiment, the actuatable piezoelectric elements 7 and the fixing piezoelectric elements 8 of the two rows 4 are arrayed in the same manner. In FIG. 6, a distance "Pn" between two adjacent actuatable piezoelectric elements 7 along the lines LA and LB of the rows of the piezoelectric actuators 4 is larger than the distance in the case of FIG. 5. However, this distance Pn can be reduced to approach the distance in the case of FIG. 5 by reducing the width of each fixing piezoelectric element 8 along the line of each row.

In FIGS. 5 and 6, horizontal arrangements of the nozzles 15 in the nozzle plate 16 on the ink jet printing head are indicated by dotted lines.

As shown in FIG. 2, the frame 5 in this embodiment includes two longitudinally extending opening 5*a* and 5*b*. The piezoelectric actuator rows 4 on the substrate 3 are encircled by the openings 5*a* and 5*b* respectively.

The frame 5 in this embodiment includes side peripheral portions 27 and 28, and a central portion 29. The side peripheral portions 27 and 28 of the frame are arranged adjacent to both sides of the piezoelectric actuator rows 4, and the central portion 29 is arranged between the two rows of the piezoelectric actuators. In addition, the frame 5 includes end peripheral portions 30 which are located at both ends of the piezoelectric actuator rows 4. These portions of the frame 5 serve to fix the ink chambers 17 within the ink jet printing head.

At an end portion of the frame 5, an ink supply hole 5*c* is provided, which location corresponds to the location of the ink supply hole 3*a* in the substrate 3.

A preferred material of the frame 5 is selected from among a resin sheet, a ceramic sheet and a metal sheet. It is necessary that the selected material of the frame 5 is well resistant to changes in temperature so the dimensions of the selected material are stably maintained. When the substrate 3 and the actuatable piezoelectric elements 7 are both made of ceramic sheets, the material of the frame 5 in a preferred embodiment is a ceramic sheet similar to the materials of the substrate 3 and the actuatable piezoelectric elements 7.

When a resin sheet is used as the material of the frame 5, the material of the frame 5 in a preferred embodiment is a mixture of a resin sheet and a filler. This filler is contained in the resin sheet in order to reduce a thermal expansivity of the frame 5. The resin sheet in the preferred embodiment is selected from among engineering plastics including polyphenylene sulfide, polyether sulfone, and polyimide; and the filler contained in the resin sheet is selected from among filler materials including titanium, alumina, glass filler, carbon, and silica.

When the above-mentioned resin sheet containing the filler for reducing the thermal expansivity is used for the frame 5, it is possible that the thermal expansion of the frame 5 is made to be substantially the same as the thermal expansion of the piezoelectric elements 7 and 8 of the piezoelectric actuator rows 4, and that the cost of the components of the ink jet printing head is reduced.

Figure 7:
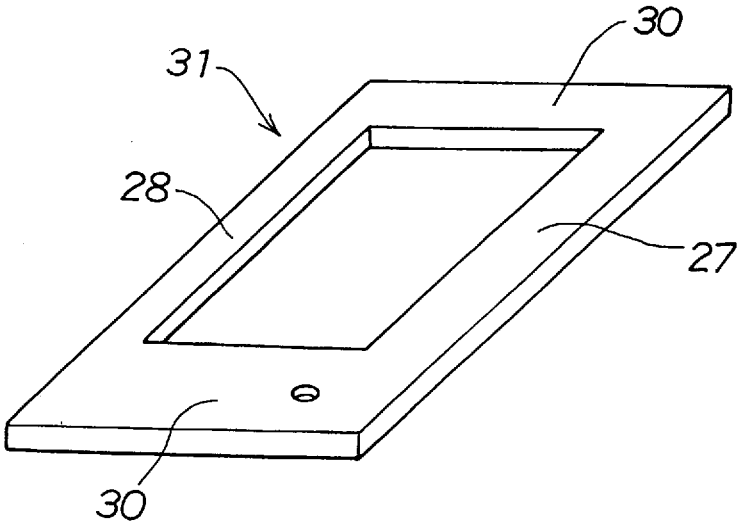
FIG. 7 is a perspective view of one embodiment of a fixing member.

FIG. 7 shows one embodiment of a fixing member which serves to fix the ink chamber unit 2 to the substrate 3. The fixing member is arranged between the ink chamber unit 2 and the substrate 3 to encircle the peripheral portions of the piezoelectric actuators. In the embodiment of FIG. 2, the frame 5 is the fixing member which serves to fix the ink chamber unit 2 to the substrate 3. The fixing member of the embodiment of FIG. 7 is a frame 31 which has a rectangular opening in the middle of the frame 31. The frame 31 includes the side peripheral portions 27 and 28 and the end peripheral portions 30 which are the same as those of the frame 5. In this frame 31, the central portion 29, which is included in the frame 5, is removed.

Figure 8:
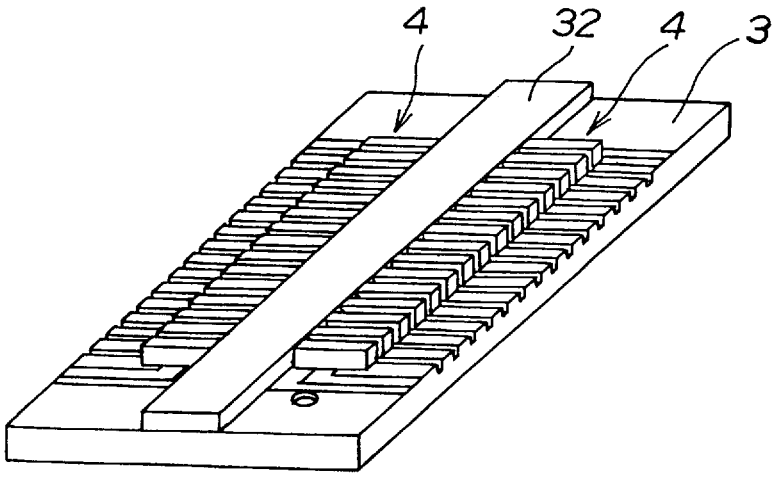
FIGS. 8 and 9 are perspective views of other embodiments of the fixing member.

FIG. 8 shows another embodiment of the fixing member which serves to fix the ink chamber unit 2 to the substrate 3. The fixing member of the embodiment of FIG. 8 is a single plate 32 arranged between the two rows 4 of the piezoelectric actuators. This plate 32 can be taken as a frame in which the central portion 29 of the frame 5 remains left and the side peripheral portions 27 and 28 of the frame 5 are removed. As shown in FIG. 8, the plate 32 is arranged on the substrate 3 and snugly fitted at the location between the piezoelectric actuator rows 4.

Figure 9:
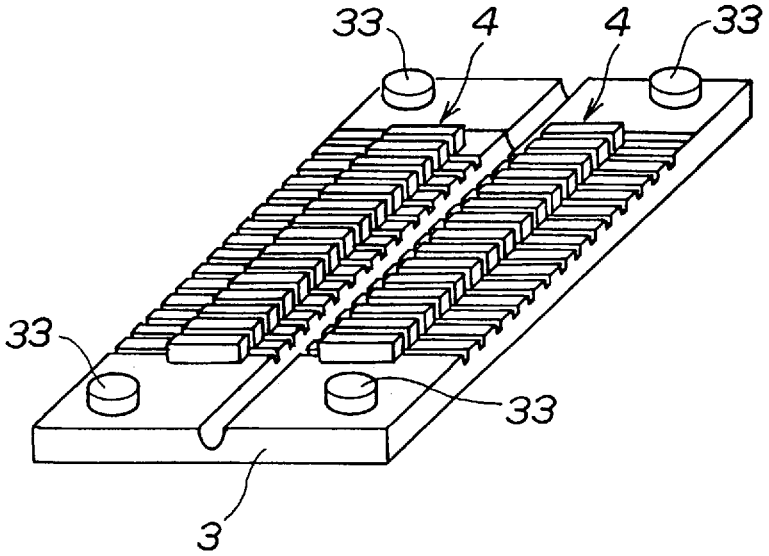

FIG. 9 shows a further embodiment of the fixing member. In FIG. 9, the fixing member in this embodiment is four supporting parts 33 which are respectively arranged at four corners of the substrate 3 and serve to fix the ink chamber unit 2 to the substrate 3. Each of the supporting parts 33 in this embodiment is cylindrical. Other supporting parts which has a different shape may be used instead of the supporting parts 33.

As shown in FIG. 3, the oscillation plate 12 includes a flat upper surface on the side of the nozzle plate 16 and a complex-shape lower surface on the side of the piezoelectric actuators 4. The oscillation plate 12 has different thicknesses at the locations of the actuatable piezoelectric elements 7 and the fixing piezoelectric elements 8.

This lower surface of the oscillation plate 12 includes diaphragm areas 12*a* with a smallest thickness in the oscillation plate 12, connected areas 12*b* and 12*e* with a greatest thickness in the oscillation plate 12, and relief areas 12*c* with an intermediate thickness. The connected areas 12*b* are connected to the actuatable piezoelectric elements 7. The fixing portions of the ink chamber unit comprising stationary portions 12*e* of oscillating plate 12 are connected to fixing piezoelectric elements 8. On the lower surface of the oscillation plate 12, each connected area 12*b* is encircled by a corresponding diaphragm area 12*a*, and each diaphragm area 12*a* is encircled by a corresponding relief area 12*c*.

Accordingly, the diaphragm portions 11 of the oscillation plate 12 are independently deformable by the actuatable piezoelectric elements 7 when actuated. This is partially because each diaphragm portion 11 is constituted by the connected area 12*b* with the greatest thickness, the diaphragm area 12*a* with the smallest thickness, and the relief area 12*c* with the intermediate thickness.

For example, the diaphragm areas 12*a* of the oscillation plate 12 are about 3–10 microns (μm) thick. As the thickness of the diaphragm areas 12*a* is not greater than 10 microns (μm), the deformation of the actuatable piezoelectric elements 7 due to the mechanical stress when actuated is efficiently transmitted to the ink within the ink chambers 17 via the oscillation plate 12. The thickness of the connected areas 12*b* is 20 microns (μm) or greater, and the connected areas 12*b* are connected to the top of each of the piezoelectric elements 7 and 8 of the piezoelectric actuator rows 4 and to the top of the frame 5. The relief areas 12*c* of the oscillation plate 12 having the intermediate thickness are formed in order to minimize the transfer of the oscillations from one of the actuatable piezoelectric elements 7 to the adjacent ones via the oscillation plate 12.

At an end portion of the oscillation plate 12, an ink supply hole 12*d* is provided, which location corresponds to the location of the ink supply hole 3*a* of the substrate 3.

The material of the above oscillation plate 12 must meet the following requirements: it provides elasticity to transfer the deformation of each piezoelectric element to a corresponding ink chamber; it is well resistant to ink; and it is less moisture permeable. In this embodiment, the oscillation plate 12 is made of a thin plate of nickel (Ni) which is cast through electroforming. As the oscillation plate 12 must firmly be connected to the top of each of the fixing piezoelectric elements 8, the material of the oscillation plate 12 in a preferred embodiment must be rigid and the Young's modulus of the material must be above 100 $kg/mm^2$. Therefore, a thin plate of nickel cast through electroforming is used as the material of the oscillation plate 12 in this embodiment.

Another material of the oscillation plate 12 is either a thin stainless-steel sheet or a thin resin sheet with a small moisture permeability. Examples of the thin resin sheet for the oscillation plate 12 are: polyphenylene sulfide, polyimide, polyether sulfone, polychlorotrifluoroethylene, and aramido.

The oscillation plate 12 in another embodiment is made of a thin metal sheet with a uniform thickness (about 3–10 microns ($\mu$m)) or a thin resin sheet with a uniform thickness (about 5–30 microns ($\mu$m)). Even if a thin resin sheet with a uniform thickness is used, the oscillation plate 12 must be highly rigid as described above.

Figure 10:
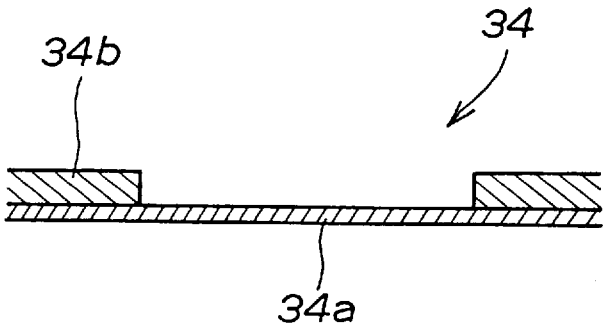
FIG. 10 is a cross-sectional view of one embodiment of an oscillation plate.

FIG. 10 shows a different oscillation plate 34 which may be used instead of the above oscillation plate 12. In this embodiment, the oscillation plate 34 has a two-layer structure comprised of a thin resin sheet 34*a* which constitutes the diaphragm portions 11, and a metal sheet 34*b* which provides a high rigidity for the connection between the oscillation plate 34 and the actuator unit 1.

The ink passage member 13 is arranged between the oscillation plate 12 and the nozzle plate 16, and it includes ink passages communicating with the respective ink chambers 17 within the ink jet printing head. This ink passage member 13 is comprised of a lower ink passage member 40 and an upper ink passage member 41.

The lower ink passage member 40 comprises a photosensitive resin film bonded to the oscillation plate 12. As shown in FIG. 3, the lower ink passage member 40 and the upper ink passage member 41 form the ink chambers 17 located above the respective actuatable piezoelectric elements 7.

As shown in FIG. 2, the lower ink passage member 40 includes a plurality of internal separator walls 43 which include fluid resistance portions 42 communicating with the respective ink chambers 17. The lower ink passage member 40 further includes an external separator wall 45 which includes a common ink chamber 44 communicating with the ink chambers 17, and the external separator wall 45 is located on the periphery of the lower ink passage member 40.

The separator walls 43 are arranged in two rows on the lower ink passage member 40, which rows correspond with the piezoelectric actuator rows 4 of the actuator unit 1. The common ink chamber 44 extends to a portion between the two rows of the separator walls 43.

The structure of the upper ink passage member 41 is substantially the same as that of the above lower ink passage member 40, but the upper ink passage member 41 includes no fluid resistance portions 42.

Figure 11:
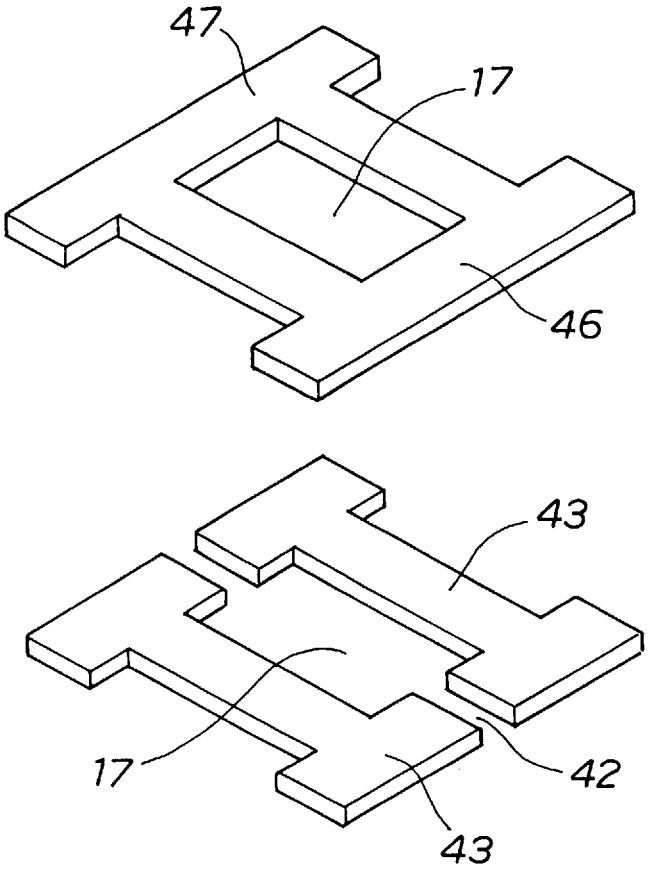
FIG. 11 is a perspective view of one embodiment of upper and lower ink passage members.

FIG. 11 shows one embodiment of the upper and lower ink passage members 41 and 40 which form the single ink chamber 17. In this embodiment, in order to form the fluid resistance portions 42 which communicate with the ink chamber 17, the lower ink passage member 49 includes separator walls 43 and the upper ink passage member 41 includes separator walls 46 and 47 which are located above the fluid resistance portions 42. Other portions of the upper ink passage member 41 are the same as corresponding portions of the lower ink passage member 40.

As shown in FIG. 3, the lower ink passage member 40 and the upper ink passage member 41 form a wall portion 48 extending in the transverse direction and arranged between the ink chamber 17 and the common ink chamber 44. On the other hand, as shown in FIG. 4, the lower ink passage member 40 and the upper ink passage member 41 form a wall portion 49 extending in the longitudinal direction and arranged between the ink chamber 17 and the common ink chamber 44. This wall portion 49 is comprised of a separator wall portion 43*a* of the lower ink passage member 40 and a separator wall portion 46*a* of the upper ink passage member 41.

Figure 12:
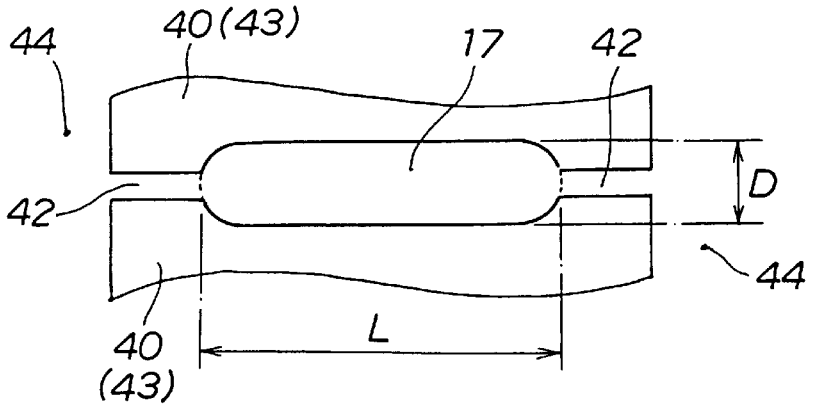
FIGS. 12 and 13 are diagrams showing an ink chamber which is formed by one embodiment of an ink chamber unit.
Figure 13:
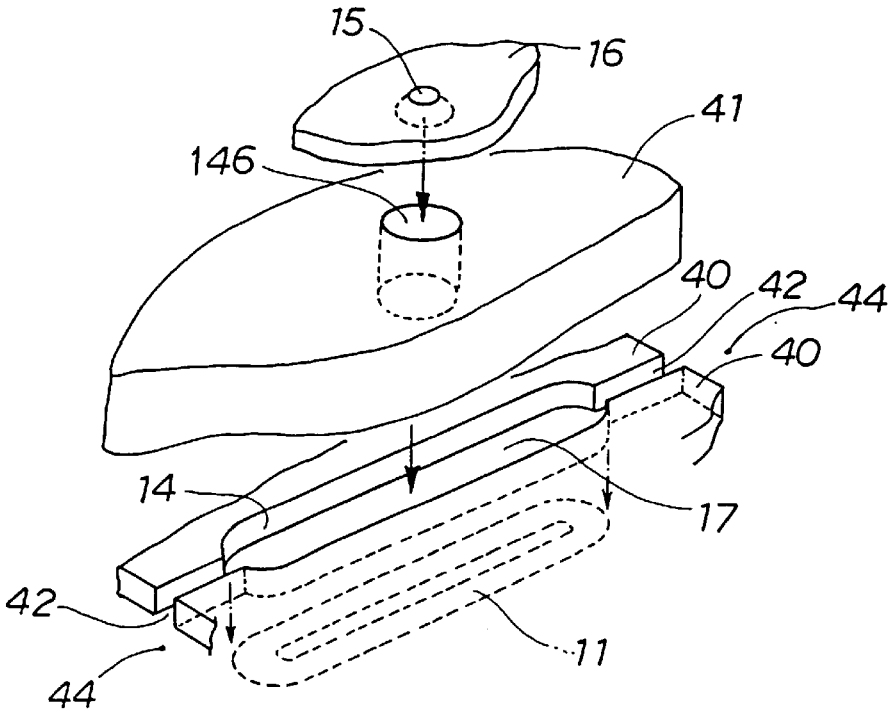

FIGS. 12 and 13 show an ink chamber 17 which is formed by the ink chamber unit 2 in one embodiment. In this embodiment, the upper ink passage member 41 includes holes 146 which are located above the centers of the ink chambers 17 in the lower ink passage member 42.

The nozzle plate 16 includes the plurality of nozzles 15 from which ink drops are forced out by the actuatable piezoelectric elements 7 when actuated. The diameter of each nozzle 15 on the outside side of the ink jet printing head is below 35 microns ($\mu$m). The nozzles 15 in the nozzle plate 16 are located above the centers of the diaphragm portions 11 of the oscillation plate 12.

Similarly to the oscillation plate 12, the nozzle plate 16 is made of a thin plate of nickel (Ni) which is cast through electroforming. The other metal materials may be used instead. An actual ink jet printing head is formed with a nozzle plate 16 in which two rows of 32 through 64 nozzles 15 are arranged. The structure and quality of the nozzle plate 16 having a total of 64 through 128 nozzles determine the ink drop configuration and the ink discharging characteristic, and they are important factors to determine the quality of images printed by the ink jet printing head.

As shown in FIG. 13, the shape of each ink chamber 17 is transversely elongated with respect to the line of each row of the piezoelectric actuators and generally the same as the shape of each diaphragm portion 11 of the oscillation plate 12. The width D of the ink chamber 17 in the longitudinal direction along the row of the nozzles 15 is smaller than the length L of the ink chamber 17 in the transverse direction at right angles to the row of the nozzles 15. Similarly, the width of each diaphragm portion 11 in the longitudinal direction is smaller than the length L of the diaphragm portion 11 in the transverse direction.

As the ink chambers 17 of the ink jet printing head are elongated in the transverse direction, the capacity of ink storage of each ink chamber needed for a desired ink discharging performance is ensured, and a high-density integration of the components of the multi-nozzle printing head is facilitated. In addition, the area of the connections between the ink chamber unit 2 and the actuator unit 1 can be raised and the bonding strength of the connections can be increased because of the elongated shape of the ink chambers 17. Further, this structure makes it possible for the ink jet printing head to prevent the interferences of adjacent ink chambers of the ink jet printing head.

Generally, to realize the above matters, the ratio of the width of each ink chamber 17 in the longitudinal direction of the head to the width of the ink chamber 17 in the transverse direction of the head is 1:(5 to 7). In a preferred embodiment wherein the capacity of ink storage of each ink chamber is small, the width of each ink chamber 17 in the transverse direction of the head is determined to be greater than twice the width of the ink chamber 17 in the longitudinal direction of the head.

In the above embodiment, the nozzles 15 in the nozzle plate 16 are respectively located above the centers of the diaphragm portions 11 of the oscillation plate 12. That is, the locations of the nozzles 15 correspond to the centers of the ink chambers 17. The ink chambers 17 in the ink chamber unit 2, and the fluid resistance portions 42 and the common ink chambers 44 communicating with the ink chambers 17, are symmetrical with respect to the line of each row of the piezoelectric actuators 4.

When the actuatable piezoelectric elements 7 and the fixing piezoelectric elements 8 of the two rows 4 are arrayed in the zigzag manner, as shown in FIG. 5, the diaphragm portions 11, the nozzles 15 and the ink chambers 17 are also arranged in accordance with the locations of the actuatable piezoelectric elements 7. Similarly, when the actuatable piezoelectric elements 7 and the fixing piezoelectric elements 8 of the two rows 4 are arrayed in the same manner, as shown in FIG. 6, the diaphragm portions 11, the nozzles 15, and the ink chambers 17 are arranged in accordance with the locations of the actuatable piezoelectric elements 7.

Figure 14:
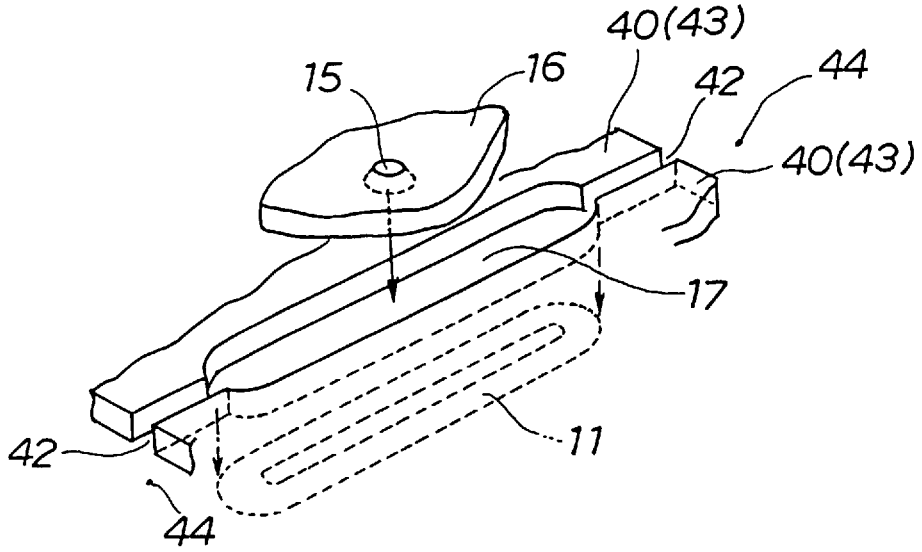
FIGS. 14 and 15 are diagrams showing ink chambers formed by other embodiments of the ink chamber unit.

FIG. 14 shows an ink chamber 17 which is formed by another ink chamber unit 2. In FIG. 14, the ink chamber unit 2 includes a lower ink passage member 40 only, and no upper ink passage member 41 is provided. In this embodiment, the nozzle plate 16 is arranged on the lower ink passage member 40 so that the ink chambers 17 are formed.

Figure 15:
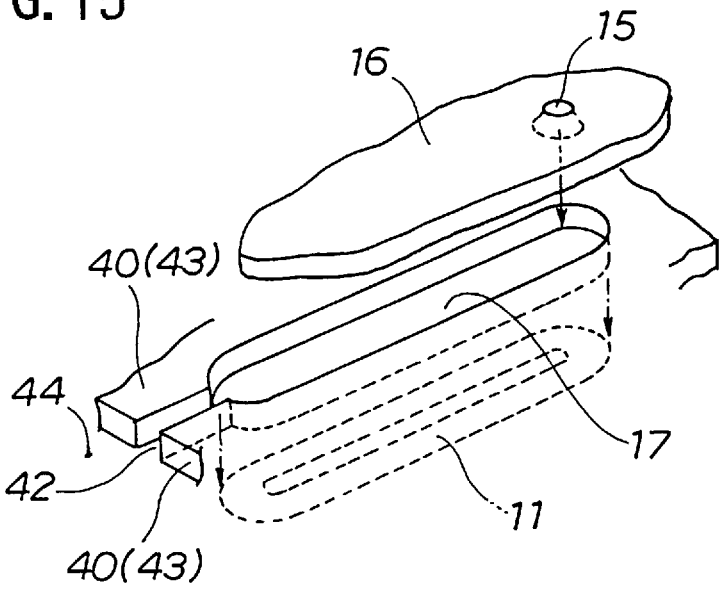

FIG. 15 shows an ink chamber 17 which is formed by a different ink chamber unit 2. In this embodiment, a lower ink passage member 40 is formed with fluid resistance portions 42 at one side of the ink chamber 17 only. The fluid resistance portions 42 communicate with the ink chambers 17 respectively. The other side of the ink chamber 17 is provided with no fluid resistance portion 42 and closed by a portion of the lower ink passage member 40. The nozzle 15 in the nozzle plate 16 is located near the closed portion of the ink chamber 17, which is arranged above the diaphragm portion 11 of the oscillation plate 12. In this embodiment, the ink chambers 17, the fluid resistance portions 42 and the common ink chambers 44 are asymmetrical with respect to the line of each row of the piezoelectric actuators 4.

Figure 16:
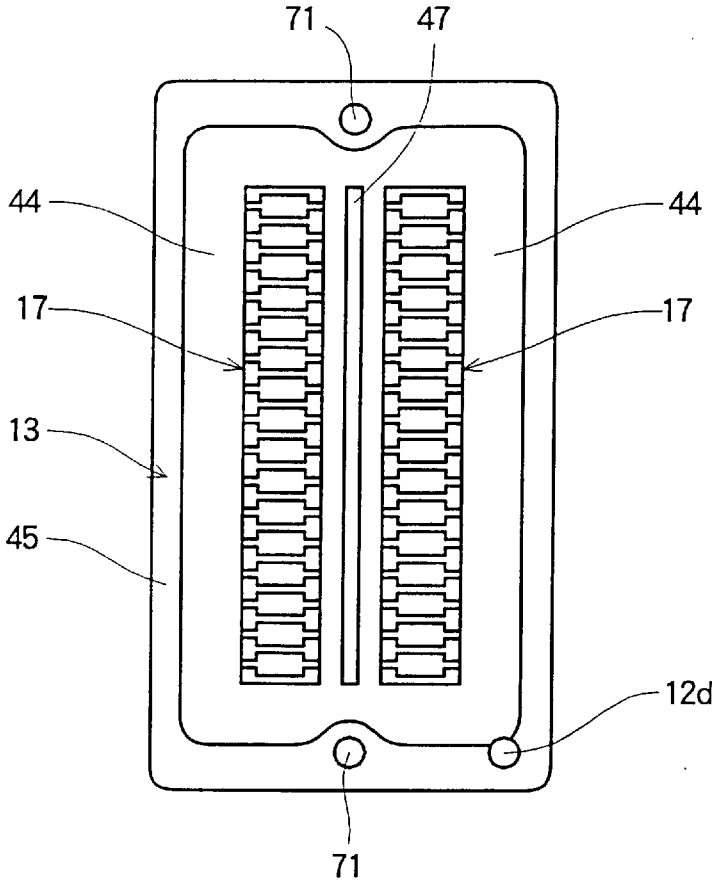
FIGS. 16 and 17 are diagrams showing one embodiment of a lower ink passage member.
Figure 17:
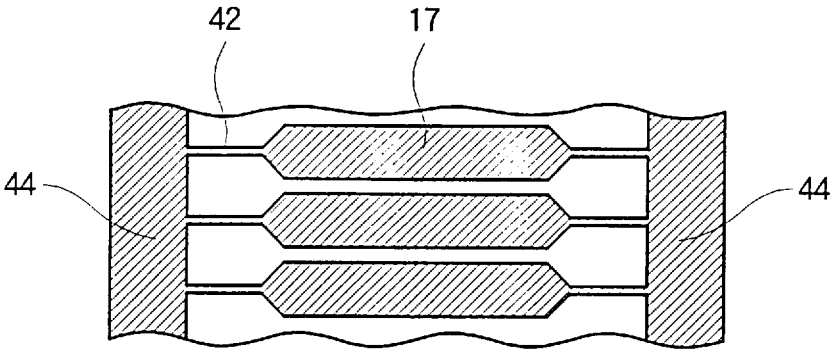

FIGS. 16 and 17 show another lower ink passage member 40 of the ink chamber unit 2. In FIGS. 16 and 17, this lower ink passage member 40 is formed with a central separator wall 47 between the two rows of the ink chambers 17. This separator wall 47 does not fully separate common ink chambers 44 of the two ink chamber rows 17 from each other, and the common ink chambers 44 of the two rows partially communicate with each other.

Figure 18:
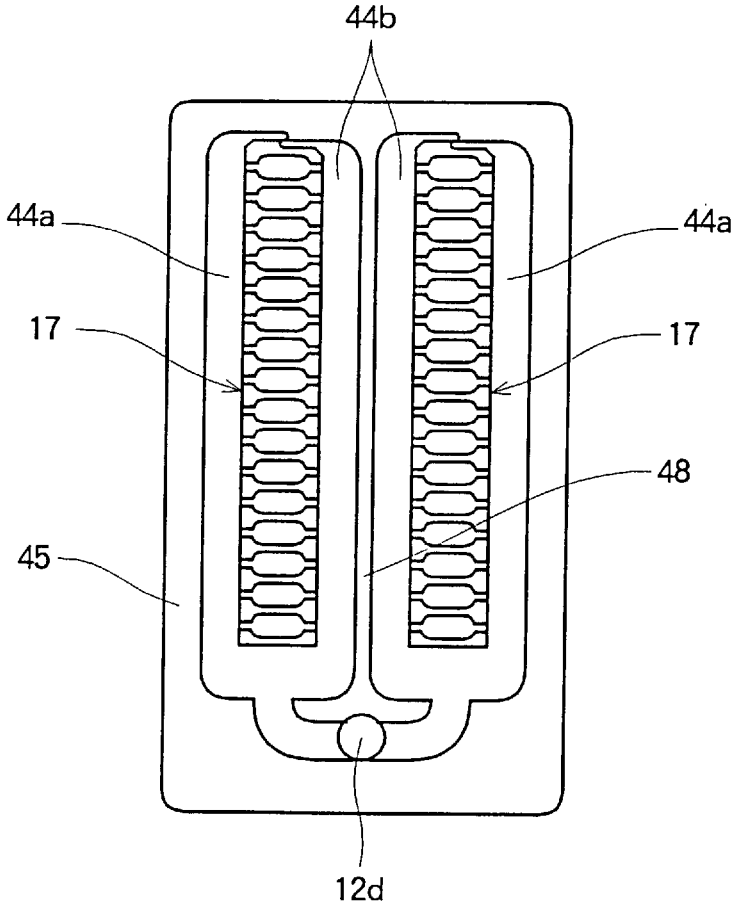
FIGS. 18 and 19 are diagrams showing another embodiment of the lower ink passage member.
Figure 19:
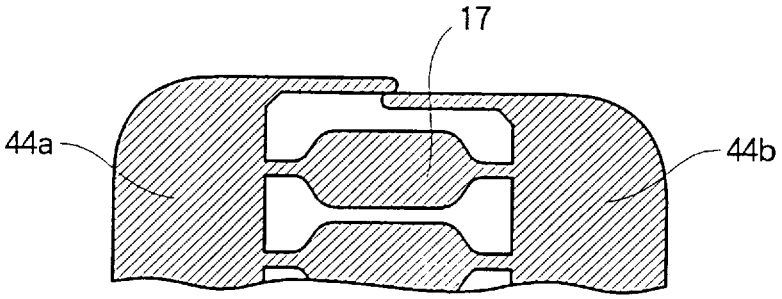

FIGS. 18 and 19 show a further lower ink passage member 40 of the ink chamber unit 2. In FIGS. 18 and 19, this lower ink passage member 40 is formed with a central separator wall 48 between the two rows of the ink chambers 17. This central separator wall 48 communicates with the outside separator wall 45. A common ink chamber 44*a* and a common ink chamber 44*b*, which have generally the same shape, are formed on both sides of each ink chamber row. The arrangement of the common ink chamber 44*a* and the common ink chamber 44*b* is symmetrical with respect to the line of each row of the piezoelectric actuators.

At an end portion of the oscillation plate 12 on which the lower ink passage member 40 is arranged, an ink supply hole 12*d* is formed.

Next, a description will be given of a method of manufacturing the ink jet printing head in one embodiment of the present invention.

When manufacturing the ink jet printing head, the actuator unit 1 and the ink chamber unit 2 are separately fabricated, and finally the two units 1 and 2 are bonded together. Because the two units are separately prepared, dust or foreign matter which occurs when preparing the actuator unit 1 do not influence the ink chamber unit 2 when it is prepared.

Figure 20:
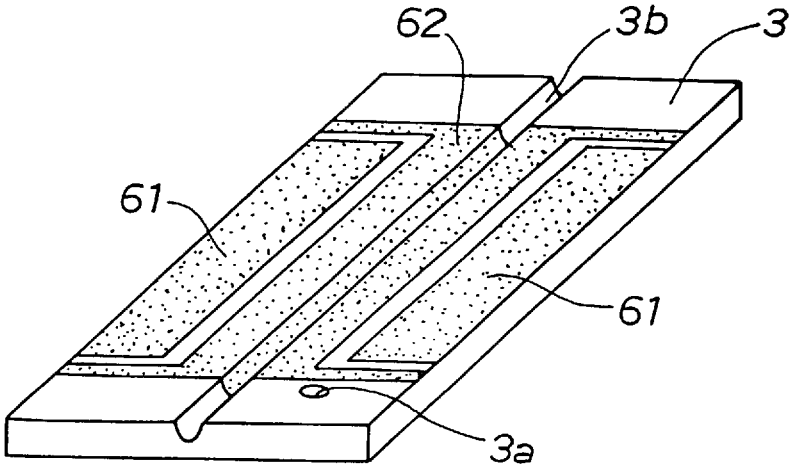
FIGS. 20, 21, and 22 are diagrams for explaining fabricating procedures for piezoelectric actuators of an ink jet printing head in one embodiment of the present invention.
Figure 21:
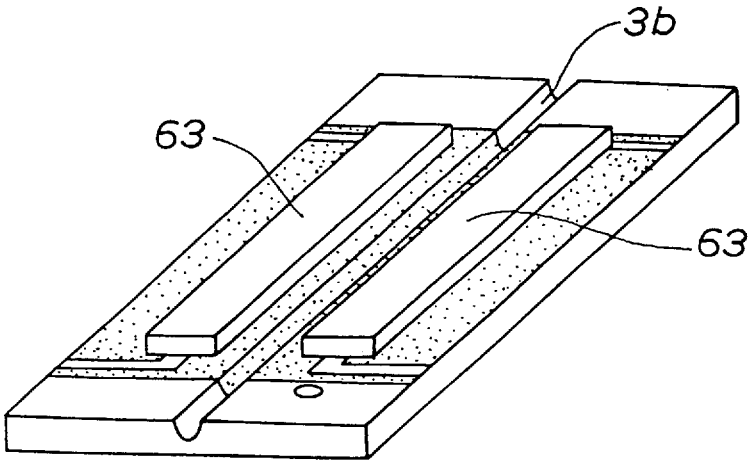
Figure 22:
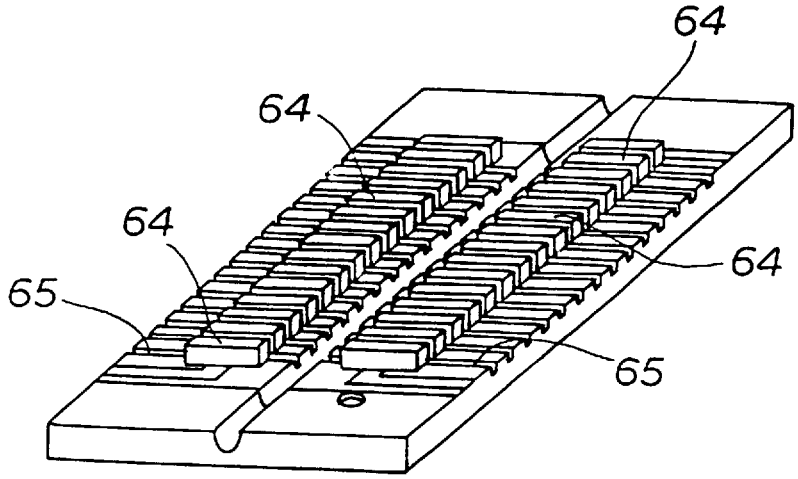

FIGS. 20 through 22 show fabricating procedures for the piezoelectric actuators of the ink jet printing head in one embodiment of the present invention. In FIG. 20, the substrate 3 is perforated to form the ink supply hole 3*a*. A groove 3*b* which is slightly deeper than a processing groove produced when cutting the piezoelectric elements is formed at a central portion of the substrate 3. This groove 3*b* is located between the two rows of the piezoelectric actuators 4. The individual drive electrodes 61 and the common electrodes 62 on the substrate 3 with the grooved central portion are roughly formed by deposition of nickel (Ni) and silver (Ag) through a patterning process.

In FIG. 21, two piezoelectric actuator units 63 wherein the end-surface electrodes 22 and 23 are formed are placed on the substrate 3 in appropriate positions by using a positioning jig, and the two piezoelectric actuator units 63 are bonded to the substrate 3 by using the adhesive agent 6. The end-surface electrodes 22 and 23 of the actuator units 63 are electrically connected to the electrodes 61 and 62 of the substrate 3 by using the conductive adhesive agent 24.

FIG. 22 shows subsequent fabricating procedures for the actuator unit 1. The two piezoelectric actuator units 63 are cut at intervals of about 100 $\mu$m along the longitudinal line by using a diamond cutter, so that individual piezoelectric elements 64 are formed. The individual piezoelectric elements 64 become the actuatable piezoelectric elements 7 and the fixing piezoelectric elements 8. At this time, processing grooves 65 on the substrate 3 are cut to separately form the individual piezoelectric elements 64. Even if the processing grooves 65 are formed to cut the patterns of the individual drive electrodes 61 and the common electrodes 62, the groove 3*b* on the substrate 3 is so deep that the electrical connection of the common electrodes 62 across the grooved central portion is retained.

Accordingly, the two rows of the piezoelectric units 4 each of which include the actuatable piezoelectric elements 7 and the fixing piezoelectric elements 8, alternately arrayed along the row, are formed on the actuator unit 1.

After the actuator unit 1 is fabricated, the frame 5 (which serves to fix the ink chamber unit 2 to the substrate 3) is bonded to the substrate 3 by using a suitable adhesive agent. It is necessary that the top surface of the frame 5 and the top surface of each of the individual piezoelectric elements 64 be placed at the same height after the bonding is performed. To realize the above matter, the thickness of the frame 5 and the thickness of each individual piezoelectric element 64 must be accurately the same. Also, it is necessary to ensure a bonding strength of the connection between the actuator unit 1 and the ink chamber unit 2.

The FPC cable 26 is connected to the individual drive electrodes 61 and to the common electrodes 62 by applying heat and pressure to the FPC cable 26 and the corresponding electrode portions. The FPC cable 26 provides a pattern of connections between the individual drive electrodes and the common electrodes 62. The actuatable piezoelectric elements 7 included in the piezoelectric elements 64 are thus selectively actuated in accordance with the incoming print signals through the FPC cable. After the connection of the FPC cable 26 is performed, the piezoelectric characteristic of each of the piezoelectric elements 64 is checked by the measurement.

Next, a description will be given of the fabricating procedures of the ink chamber unit 2.

A photosensitive resin sheet which is about 20–50 microns ($\mu$m) thick is attached to the flat surface of the frame 5, and it is laminated by applying heat and pressure. A masking of a pattern of the lower ink passage member 40 is attached to the photosensitive resin sheet, and they are exposed to ultraviolet rays. When the pattern is developed, the exposed portions of the photosensitive resin sheet are cured, and the non-exposed portions thereof are removed by using a suitable solvent. Thus, the lower ink passage member 40 having the ink passage pattern formed therein is prepared. After the rinsing and the drying, the photosensitive resin sheet is again exposed to ultraviolet rays so that the ink passage portions are fully cured.

Similarly, a photosensitive resin sheet which is about 40–100 microns ($\mu$m) thick is attached to the bottom surface of the nozzle plate 16, and it is laminated by applying heat and pressure. A masking of a pattern of the upper ink passage member 41 is attached to the photosensitive resin sheet, and they are exposed to ultraviolet rays. Thus, the upper ink passage member 41 having the ink passage pattern formed therein is prepared. As described above, the upper ink passage member 41 includes no fluid resistance portions 42. After the rinsing and the drying, the photosensitive resin sheet is again exposed to ultraviolet rays so that the ink passage portions are fully cured.

After the above procedures are performed, the upper ink passage member 41 beneath the nozzle plate 16 is attached to the lower ink passage member 40 on the frame 5 by using a positioning jig, and they are bonded to each other by applying heat and pressure. At this time, they are heated to a temperature above the temperature during the above curing.

When the above procedures for preparing the ink chamber unit 2 are carried out by the actual assembly line, several ink chamber units 2 for a plurality of ink jet printing heads are produced at the same time.

The nozzle plate 16 is arranged on the oscillation plate 12. In order to increase the accuracy of the alignment of the nozzle plate 16 to the oscillation plate 12, the nozzle plate 16 is formed with two alignment marks 72 at end portions thereof which are of the same shape and different in size, and the oscillation plate 12 (including the upper and lower ink passage members 41 and 40) is formed with two alignment marks 71 at end portions thereof which are of the same shape and different in size. The locations of the alignment marks 72 of the nozzle plate 16 correspond to the locations of the alignment marks 71 of the oscillation plate 12.

Therefore, in the above embodiment, when the nozzle plate 16 is arranged on the oscillation plate 12, the alignment marks 72 and the alignment marks 71 are fitted to each other. The size of one of the alignment marks is different from the size of the other one to avoid the misalignment of the two plates 12 and 16 when assembling them, thereby increasing the accuracy of the alignment thereof. In the above embodiment shown in FIG. 2, the alignment marks 71 and 72 are circular. However, the shape of the alignment marks 71 and 72 may be different than the circular shape, and alignment marks of a polygonal shape or a cross shape may be used instead.

After both the procedures for preparing the actuator unit 1 and the ink chamber unit 2 are performed, the actuator unit 1 and the ink chamber unit 2 are bonded to each other by using a suitable adhesive agent. The joining procedures to join the actuator unit 1 and the ink chamber unit 2 will now be explained.

An epoxy adhesive resin is applied to the top surface of each of the piezoelectric elements 64 and the top surface of the frame 5 by using a screen printing machine. The adhesive agent is applied to the entire surface of each of the fixing piezoelectric elements 8 (included in the individual piezoelectric elements 64), in order to ensure the rigidity of the connection between the ink chamber unit 2 and the actuator unit 1.

However, it should be noted that applying the adhesive agent to the entire surface of each of the actuatable piezoelectric elements 7 (included in the piezoelectric elements 64) is not suitable. In order to efficiently transfer the deformation from each of the actuatable piezoelectric elements 7 to the ink within the ink chambers 17 via the oscillation plate 12, it is necessary to apply the adhesive agent to only a center area of the top surface of each of the actuatable piezoelectric elements 7 as shown in FIG. 3.

Accordingly, in the above embodiment, the area of each of the connections between the fixing piezoelectric elements 8 and the ink chamber unit 2 is greater than the area of each of the connections between the actuatable piezoelectric elements 7 and the diaphragm portions 11. This makes it possible that the diaphragm portions 11 of the oscillation plate 12 be independently deformable for each of the actuatable piezoelectric elements 7 in accordance with the pint signals.

Next, a description will be given of an operation of the ink jet printing head in one embodiment of the present invention.

When the ink jet printing head is operated, a drive pulse with the voltage of 20–50 volts is supplied to one of the actuatable piezoelectric elements 7 of the actuator unit 2 in accordance with the print signal. The actuatable piezoelectric element 7 is actuated in accordance with the print signal to deform the corresponding one of the diaphragm portions 11 of the oscillation plate 12 in the laminating direction toward the nozzle 15. The volume of the corresponding ink chamber 17 is changed by the deformation of the diaphragm portion 11 to pressurize the ink within the ink chamber 17, and an ink drop is forced out from the corresponding nozzle 15 of the nozzle plate 16, so that the printing of an image on paper is carried out.

When the ink drop is forced out from the nozzle 15, the pressure of the ink within the ink chamber 17 is lowered to a slightly negative pressure. The supplying of the print signal to the actuatable piezoelectric element 7 is turned off at this time. The diaphragm portion 11 of the oscillation plate 12 is returned to the original condition without deformation. The pressure of the ink within the ink chamber 17 is further lowered.

Because of the negative pressure of the ink chamber 17 at this time, the ink newly supplied from the ink supply pipe 19 via the common ink chamber 44 enters the ink chamber 17 through the fluid resistance portion 42. After the oscillation of the meniscus of the ink at the nozzle 15 is attenuated and stabilized, a subsequent drive pulse is supplied to the actuatable piezoelectric element 7 so that an ink drop is forced out from the nozzle 15.

In the above-described ink jet printing head, the diaphragm portions 11 (the diaphragm areas 12*a*) have the smallest thickness in the oscillation plate 12, and the deformation of the actuatable piezoelectric elements 7 when actuated is efficiently transmitted to the ink within the ink chamber 17 via the oscillation plate 12. The connected areas 12*b* have the greatest thickness in the oscillation plate 12, and the connections of the actuatable piezoelectric elements 7 and the oscillation plate 12 are solidly made by the adhesive agent. The transmission of the oscillations from one of the ink chambers 17 to the other adjacent ink chambers 17 is minimized because the oscillation plate 12 has the relief areas 12*c* with the intermediate thickness which encircle the diaphragm portions 11.

When the ink drop is discharged from the nozzle 15, the counter-flow of the ink from the ink chamber 17 to the common ink chamber 44 may be produced. The fluid resistance portion 42 includes a reduced cross-sectional area which is smaller than a cross-sectional area of the other areas. Therefore, the ink jet printing head can prevent the efficiency of the ink discharging from being lowered, because the upper and lower ink passage members 41 and 40 include the fluid resistance portions 42.

In the above-described ink jet printing head, the actuatable piezoelectric elements 7 of the actuator unit 1 are respectively connected to the diaphragm portions 11 of the oscillation plate 12. The fixing piezoelectric elements 8 of the actuator unit 1 are respectively connected to the other portions of the oscillation plate 12 which are located between the diaphragm portions 11, and the frame 5 serves to fix the ink chamber unit 2, including the ink respective ink chambers 17, to the substrate 3. The rigidity of the multi-nozzle ink jet printing head is increased.

Accordingly, in the above embodiment, the transmission of the oscillations of the actuatable piezoelectric elements 7 due to the mechanical stress when actuated from one actuatable piezoelectric element to another is minimized. The interference between the deformations of adjacent ones of the piezoelectric elements is remarkably reduced and the efficiency of the ink discharging is increased and stabilized.

As described above, the ink jet printing heads in the above embodiments of the present invention provide the features and advantages which follow.

(1) The actuatable piezoelectric elements 7 are deformed at high speed in the laminating direction in accordance with the print signals. The pressure of the ink within the ink chambers 17 is instantaneously increased by the deformation of the actuatable piezoelectric elements 7, and the ink discharging is performed without delay from the time the print signals are applied.

(2) The diaphragm portions 11 (the diaphragm areas 12*a*) which form the part of the respective ink chambers 17 have the smallest thickness in the oscillation plate 12, and they are readily deformable. The deformation of the actuatable piezoelectric elements 7 when actuated is efficiently transmitted to the ink within the ink chambers 17 to increase the pressure of the ink without loss.

(3) The shape of the ink chambers 17 above the oscillation plate 12 is substantially the same as the shape of the diaphragm portions 11 of the oscillation plate 12. Thus, a smallest possible amount of ink within the ink chambers 17 can be discharged from the nozzles 15.

(4) The nozzles 15 of the nozzle plate 16 are located above the diaphragm portions 11 of the oscillation plate 12 connected to the actuatable piezoelectric elements 7. Thus, when the deformation of the diaphragm portions 11 is transmitted to the ink within the ink chambers 17, the pressure of the ink is efficiently increased at high speed to force out ink drops from the nozzles 15. The efficiency of the ink discharging is increased.

Next, a description will be given of ink jet printing heads in various other embodiments of the present invention.

Figure 23:
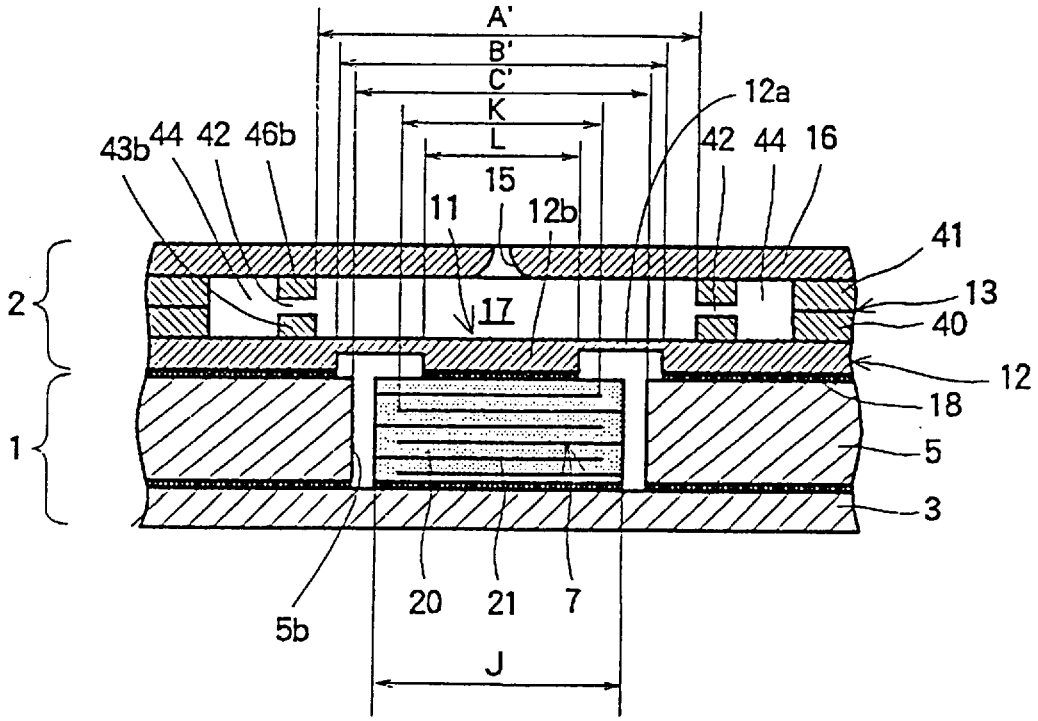
FIG. 23 is a cross-sectional view of an ink jet printing head in another embodiment of the present invention taken along a transverse line as shown in FIG. 3.
Figure 24:
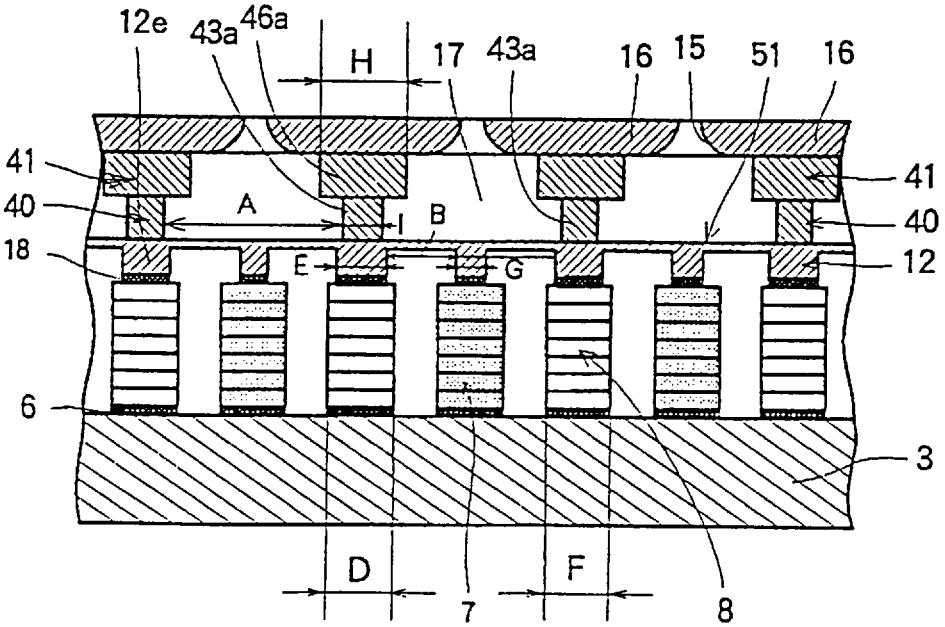
FIG. 24 is a cross-sectional view of the ink jet printing head in FIG. 23 taken along a longitudinal line as shown in FIG. 4.

FIG. 23 shows an ink jet printing head in one embodiment of the present invention, a cross section of which is taken along a transverse line as shown in FIG. 3. FIG. 24 shows a cross section of the ink jet printing head in FIG. 23 which is taken along a longitudinal line as shown in FIG. 4.

The basic structure of this ink jet printing head in FIGS. 23 and 24 is the same as that of the above-described ink jet printing head, the elements which are the same as corresponding elements in FIGS. 3 and 4 are designated by the same reference numerals.

This embodiment of FIGS. 23 and 24 is different from the previous embodiment of FIGS. 3 and 4 as in the following. The oscillation plate 12 in this embodiment includes two areas with different thicknesses: diaphragm areas 12*a* having a smallest thickness in the oscillation plate 12 and connected areas 12*b* having a greatest thickness in the oscillation plate 12. The ink supply passages 42 which form the fluid resistance portions are arranged between the separator walls 43 of the lower ink passage member 40 and the separator walls 46 of the upper ink passage member 41.

In the ink jet printing head in this embodiment, as shown in FIG. 24, a width A of the ink chamber 17 formed by the lower ink passage member 40 in the longitudinal direction is greater than a distance B of the diaphragm portions 11 of the oscillation plate 12 in the longitudinal direction. This distance B of the diaphragm portions 11 is greater than a distance C of the fixing piezoelectric elements 8 of the piezoelectric actuator row 4. Thus, the ink jet printing head in this embodiment meets the structural relationship: A>B>C.

Similarly, in the ink jet printing head in this embodiment, as shown in FIG. 23, a width A' of the ink chamber 17 in the transverse direction is greater than a distance B' of the diaphragm portions 11 in the transverse direction, and this distance B' of the diaphragm portions 11 is greater than a width C' of the opening of the frame 5 in the transverse direction. That is, the ink jet printing head in this embodiment meets also the structural relationship: A'>B'>C'.

In the above embodiment, the distance B of the diaphragm portions 11 in the longitudinal direction is greater than the distance C of the fixing piezoelectric elements 8, and a distance D of the fixing piezoelectric elements 8 on the piezoelectric actuator rows 4 in the longitudinal direction is greater than a distance E of the portions 12*e* of the oscillation plate 12. In addition, it is necessary that the differences (A−B) and (B−C) are greater than the bonding accuracy of the dimensions when performing the fabricating procedures.

Further, in the above embodiment, the distance D of the fixing piezoelectric elements 8 in the longitudinal direction is greater than a distance E of the actuatable piezoelectric elements 7 in the longitudinal direction. The distance E of the portions 12*e* of the oscillation plate 12 in the longitudinal direction is greater than the distance G of the portions 12*b* of the oscillation plate 12 which portions are connected to the actuatable piezoelectric elements 7.

Further, in the above embodiment, a distance H of the separator walls 46*a* of the upper ink passage member 13 in the longitudinal direction (FIG. 24) is greater than a distance I of the separator walls 43*a* of the lower ink passage member 40. In addition, as shown in FIG. 23, a width J of the end surfaces of the actuatable piezoelectric elements 7 in the transverse direction is greater than a width K of the ends of the internal electrodes 20, and this width K is greater than a width L of the diaphragm portion 11 of the oscillation plate 12 in the transverse direction. The ink passage member 40 in this embodiment meets the structural relationship: J>K>L.

In the above-described embodiment, the deformation of the actuatable piezoelectric elements 7 when actuated is efficiently transmitted to the ink within the ink chambers 17. Thus, it is possible to increase the efficiency of the ink discharging by minimizing the interference between the ink chambers and reducing the mounting misalignment. Also, it is possible to make the multi-nozzle ink jet printing head efficient to perform a high-frequency piezoelectric actuation with equal ink discharging operations of the ink chambers.

Figure 25:
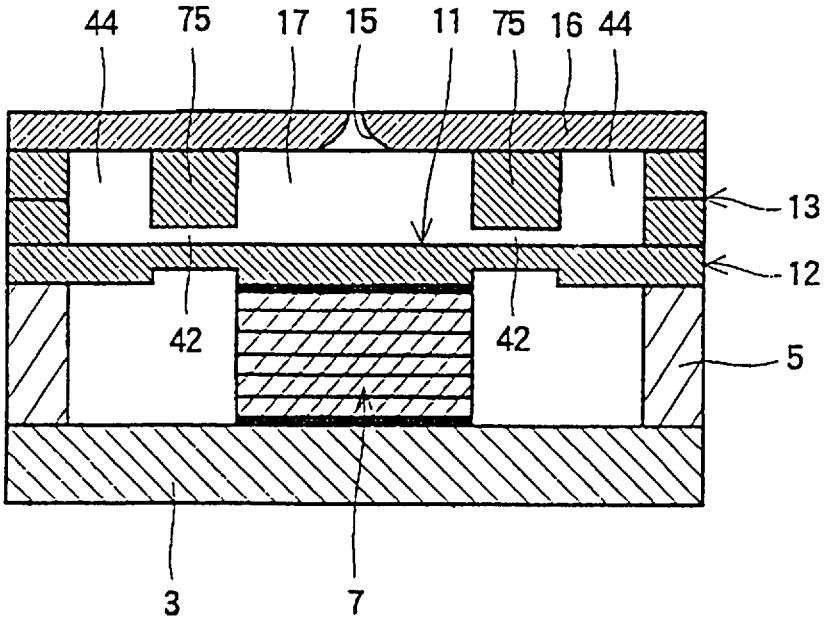
FIG. 25 is a cross-sectional view of an ink jet printing head in a further embodiment of the present invention as shown in FIG. 3.
Figure 26:
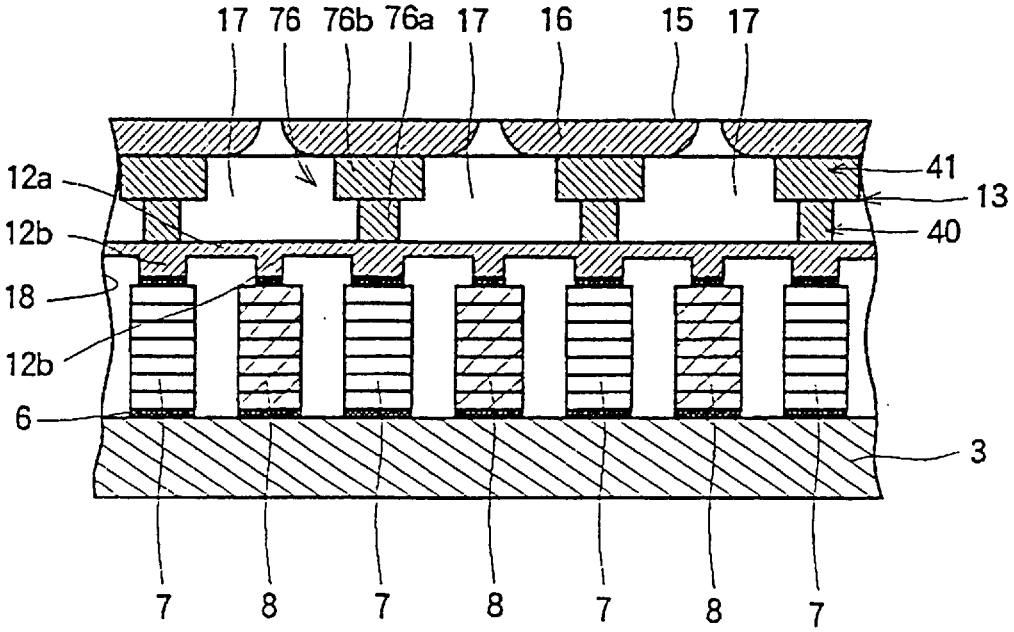
FIG. 26 is a cross-sectional view of the ink jet printing head in FIG. 25 as shown in FIG. 4.

FIG. 25 shows a cross section of an ink jet printing head in a further embodiment of the present invention as shown in FIG. 3. FIG. 26 shows a cross section of the ink jet printing head in FIG. 25 as shown in FIG. 4.

The basic structure of this ink jet printing head in FIGS. 25 and 26 is the same as that of the above-described ink jet printing head, the elements which are the same as corresponding elements in FIGS. 3 and 4 are designated by the same reference numerals.

In the embodiment of FIGS. 25 and 26, the piezoelectric actuator rows 4, each row including the actuatable piezoelectric elements 7 and the fixing piezoelectric elements 8 alternately arrayed along the row, are bonded to the insulating substrate 3 by using the adhesive agent. The frame 5 which encircles the piezoelectric actuator rows 4 is arranged on the substrate 3. The oscillation plate 12 including the diaphragm portions 11 is bonded onto the piezoelectric actuator rows 4 and the frame 5 by using the adhesive agent. The oscillation plate 12 has two areas with different thicknesses: diaphragm areas 12*a* having a smallest thickens in the oscillation plate 12 and connected areas 12*b* having a greatest thickness in the oscillation plate 12.

The ink passage member 13 including two layers made of the dry film resist is bonded onto the oscillation plate 12. The nozzle plate 16 including the nozzles 15 is bonded onto the ink passage member 13. Each of the ink chambers 17 is constituted by the oscillation plate 12, the ink passage member 13, and the nozzle plate 16. In FIG. 25, the common ink chambers 44 are arranged on both sides of the ink chamber 17, and the ink supply passages 24 are formed by members 75 to connect the common ink chambers 44 to the ink passage 17. In addition, as shown in FIG. 26, separator walls 76 including lower wall portions 76*a* and upper wall portions 76*b* which are made of the dry film resist are arranged between the adjacent ink chambers 17 to separate the ink chambers 17 one from another. This structure of the ink jet printing head is applicable to not only the piezoelectric actuation type printing head but also the bubble jet printing head using the heater elements.

The members 75 have, as shown in FIG. 25, a constant width regardless of the distance from the actuatable piezoelectric element 7, and the separator walls 76 are, as shown in FIG. 26, formed such that the width of the upper wall portions 76*b* is greater than the width of the lower wall portions 76*a*. Thus, in this embodiment, the width of each ink chamber 17 in the transverse direction shown in FIG. 25 is not varied, and the width of each ink chamber 17 in the longitudinal direction shown in FIG. 26 is varied in a manner that the width becomes smaller as the distance from the actuatable piezoelectric element 7 is greater.

In the above-described embodiment, the deformation of the actuatable piezoelectric elements 7 when actuated is efficiently transmitted to the ink within the ink chambers 7. Thus, it is possible to increase the efficiency of the ink discharging by minimizing the interference between the ink chambers and reducing the mounting misalignment. Also, it is possible to make the multi-nozzle ink jet printing head efficient to perform a high-frequency piezoelectric actuation with equal ink discharging operations of the ink chambers.

Figure 27:
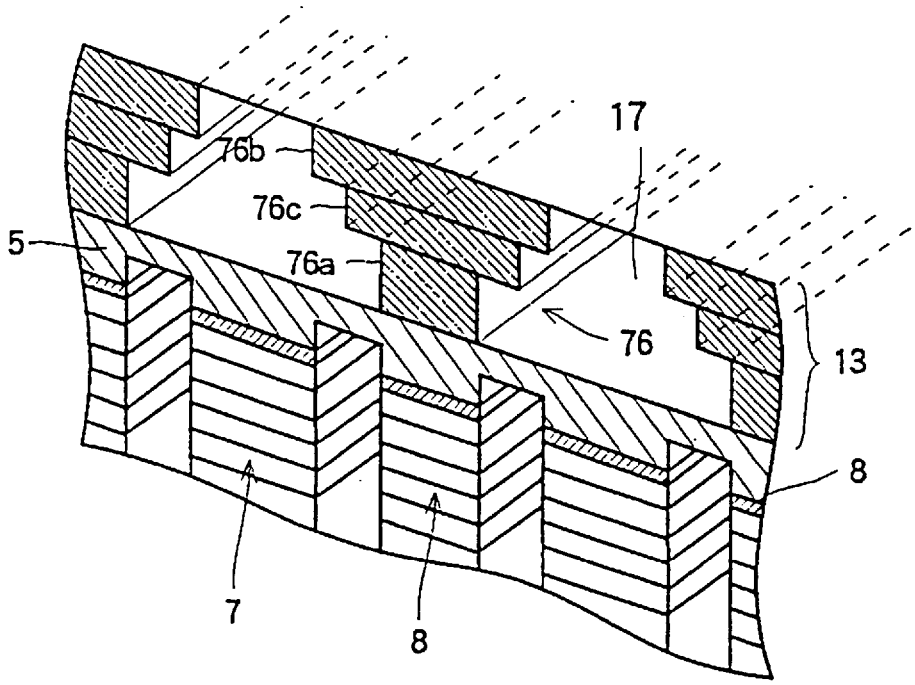
FIG. 27 is a perspective view of an ink jet printing head in another embodiment of the present invention.

FIG. 27 shows an ink jet printing head in another embodiment of the present invention.

In the embodiment of FIG. 27, each of the separator walls 76 includes a lower wall portion 76*a*, an upper wall portion 76*b*, and a middle wall portion 76*c*. A width of the lower wall portion 76*a* in the longitudinal direction is smallest in the separator wall 76, a width of the upper wall portion 76*b* in the longitudinal direction is greatest in the separator wall 76, and a width of the middle wall portion 76*c* is intermediate in length. Thus, in this embodiment, a width of each ink chamber 17 in the longitudinal direction is varied in three steps in a manner than the width becomes smaller as a distance from the actuatable piezoelectric element 7 is greater.

Figure 28:
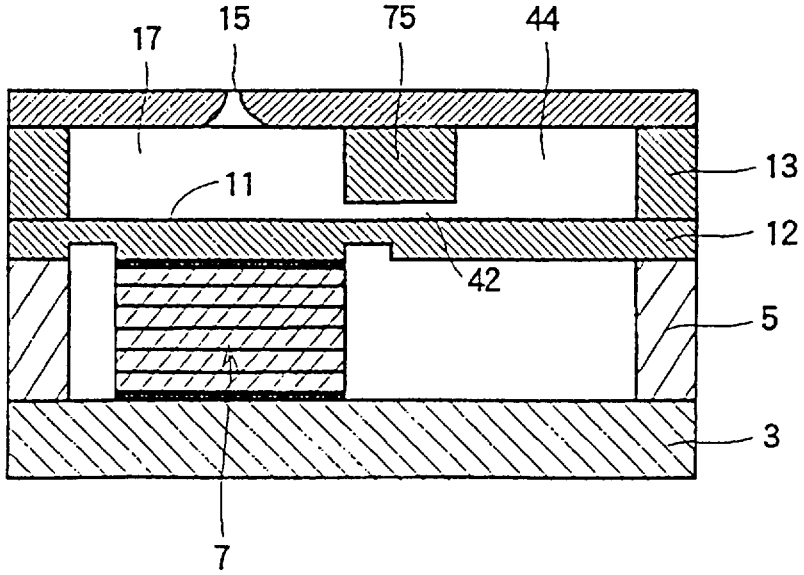
FIG. 28 is a cross-sectional view of an ink jet printing head in still another embodiment of the present invention as shown in FIG. 4.

FIG. 28 shows a cross section of an ink jet printing head in still another embodiment of the present invention as shown in FIG. 4. In FIG. 28, the common ink chamber 44 is arranged on one side of the ink chamber 17, and the member 75 is arranged to form the ink supply passage 42. The common ink chamber 44 communicates with the ink chamber 17 via the ink supply passage 42. The previously-described embodiments may be applied to the ink jet printing head in FIG. 28 in the same manner.

Figure 29:
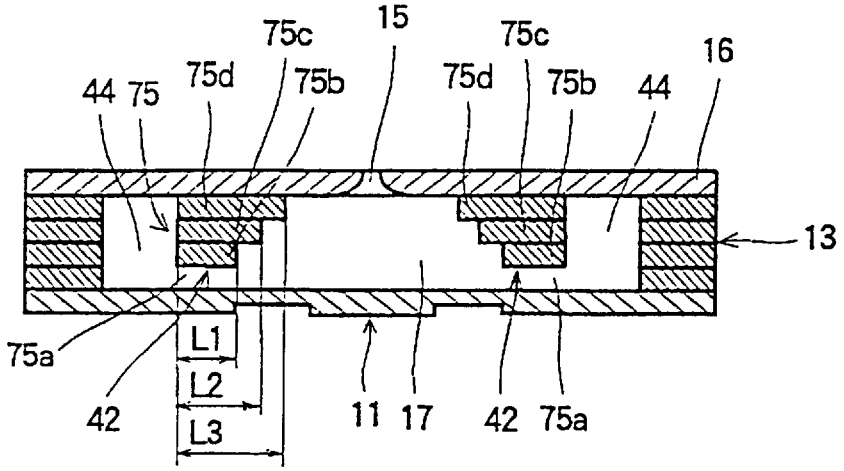
FIG. 29 is a cross-sectional view of an ink jet printing head in a further embodiment of the present invention as shown in FIG. 4.

FIG. 29 shows an ink jet printing head in a further embodiment of the present invention as shown in FIG. 4. In FIG. 29, the common ink chambers 44 are arranged on both sides of the ink chamber 17, and the members 75 are arranged to form the ink supply passages 42. The ink passage member 13 has four layers made of the dry film resist, and each of the members 75 has three layers 75*b* through 75*d* made of the dry film resist. Portions 75*a* of the members 75 are formed as the ink supply passages 42. The widths L1, L2, and L3 of the layers 75*b*, 75*c*, and 75*d* are, as shown in FIG. 29, formed to meet the structural relationship: L1<L2<L3. The side surfaces of the layers 75*b*, 75*c*, and 75*d* which face the common ink chambers 44 are made flat, and the opposite side surfaces of the layers are formed stepwise.

In the embodiment of FIG. 29, the width of the ink chamber 17 in the longitudinal direction is varied in four steps in a manner that the width becomes smaller as the distance from each actuatable piezoelectric element 7 is greater. Thus, the deformation of the actuatable piezoelectric elements 7 when actuated is efficiently transmitted to the ink within the ink chambers 17.

Figure 30:
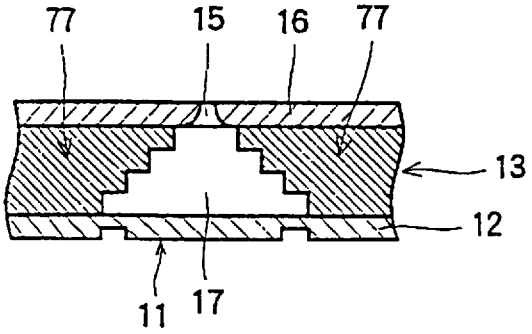
FIG. 30 is a cross-sectional view of an ink jet printing head in a further embodiment of the present invention as shown in FIG. 3.

FIG. 30 shows an ink jet printing head in a further embodiment of the present invention as shown in FIG. 3. In FIG. 30, the ink passage member 13 is comprised of the separator walls 77, and the separator walls 77 have stepwise layers made of the dry film resist. The widths of the stepwise layers in the transverse direction are, as shown in FIG. 30, formed to meet the structural relationship which is similar to the structural relationship of the embodiment of FIG. 29.

Also, in the embodiment of FIG. 30, the width of the ink chamber 17 in the transverse direction is varied stepwise in a manner that the width becomes smaller as the distance from each actuatable piezoelectric element 7 is greater. Thus, the deformation of the actuatable piezoelectric elements 7 when actuated is efficiently transmitted to the ink within the ink chambers 17.

Figure 31:
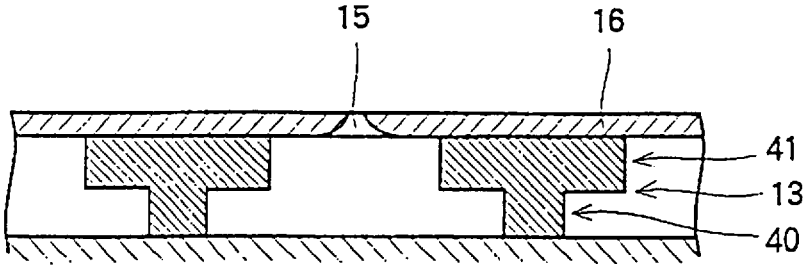
FIG. 31 is a cross-sectional view of an ink jet printing head in a further embodiment of the present invention as shown in FIG. 3.
Figure 32:
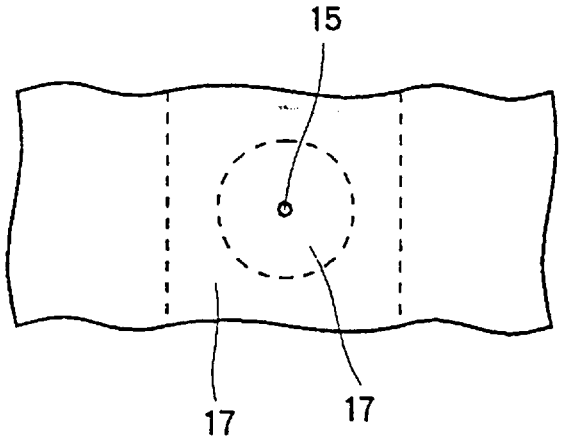
FIG. 32 is a top view of an ink passage member of the ink jet printing head in FIG. 31.

FIGS. 31 and 32 show an ink passage member of an ink jet printing head in a further embodiment of the present invention. In FIGS. 31 and 32, the upper ink passage member 41 of the ink passage member 13 forms a cylindrical ink chamber 17 the center of which is arranged below the nozzle 15 of the nozzle plate 16. The lower ink passage member 40 includes separator walls having a smaller width. By this ink passage member, a width of the ink chamber 17 in the transverse direction and a width of the ink chamber 17 in the longitudinal direction are both varied in a manner that the widths become smaller as the distance from each actuatable piezoelectric element 7 is greater. Therefore, the efficiency of the ink discharging of the ink jet printing head is increased, and the interference of the ink chambers is reduced.

Figure 33:
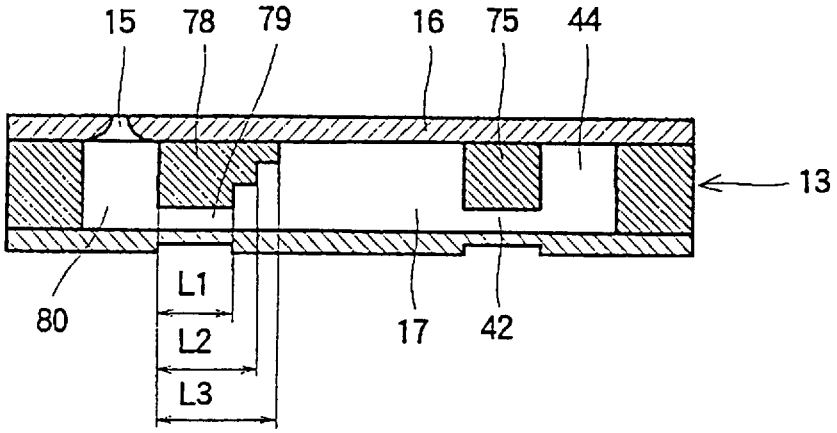
FIGS. 33 through 35 are cross-sectional views of variations of the ink passage member of the ink jet printing head in FIGS. 31 and 32.
Figure 34:
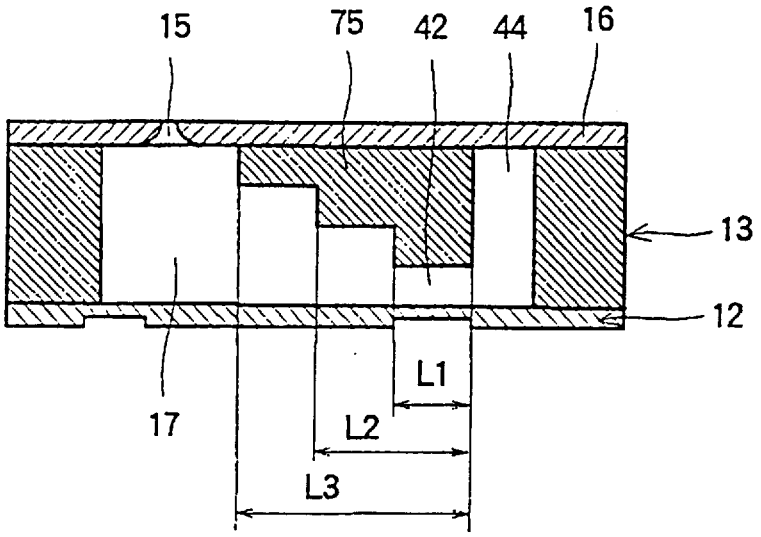
Figure 35:
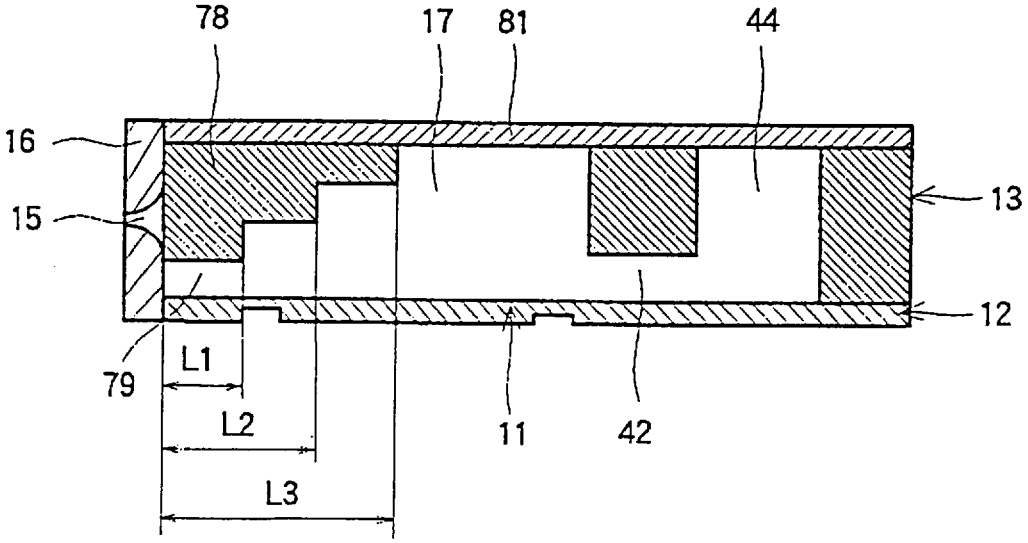

FIGS. 33 through 35 show variations of the ink passage member of the ink jet printing head in FIGS. 31 and 32. By these ink passage members, a width of the ink chamber 17 is varied in a manner that the width becomes smaller as the distance from each actuatable piezoelectric element 7 is greater.

In FIG. 33, the common ink chamber 44 is arranged on one side of the ink chamber 17. This common ink chamber 44 is formed by a member 75, and communicates with the ink chamber 17 via the ink supply passage 42. An ink discharge chamber 80 is arranged on the other side of the ink chamber 17. This ink discharge chamber 80 is formed by a member 78, and communicates with the ink chamber 17 via an ink discharge passage 79. The nozzle 15 of the nozzle plate 16 is opened to this ink discharge chamber 80. The member 78 includes stepped portions with different widths as shown in FIG. 33. The widths of the stepped portions of the member 78 meet the relationship: $L1<L2<L3$. Therefore, in this embodiment, the width of the ink chamber 17 is varied in a manner that the width becomes smaller as the distance from each actuatable piezoelectric element 7 is greater.

In FIG. 34, the common ink chamber 44 is formed by the member 75, and communicates with the ink chamber 17 via the ink supply passage 42. The member 75 includes stepped portions with different widths. The widths of the stepped portions of the member 75 meet the relationship: $L1<L2<L3$. In this embodiment, also, the width of the ink chamber 17 is varied in a manner that the width becomes smaller as the distance from each actuatable piezoelectric element 7 is greater.

In FIG. 35, the common ink chamber 44 is formed by the member 75, and communicates with the ink chamber 17 via the ink supply passage 42. A member 78 which includes stepped portions with different widths is arranged on the other side of the ink chamber 17. The nozzle 15 of the nozzle plate 16 is arranged on one side of the ink chamber unit, and the nozzle 15 is opened to the ink chamber 17 via an ink discharge passage 79. A plate member 81 is arranged on the top of the ink chamber unit, and it is opposite to the oscillation late 11. This ink jet printing head is called a side shooter type. In this embodiment, also, the width of the ink chamber 17 is varied in a manner that the width becomes smaller as the distance from each actuatable piezoelectric element 7 is greater.

Figure 36:
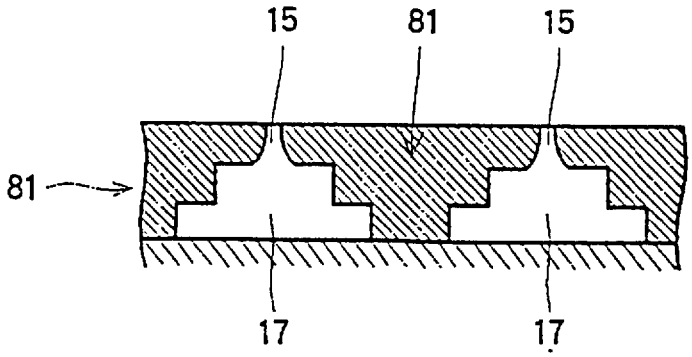
FIG. 36 is a cross-sectional view of another ink passage member which is formed through an electroforming process.

FIG. 36 shows another ink passage member which is produced through an electroforming process. In FIG. 36, an ink passage member 81 includes the ink chambers 17, arranged above the oscillation plate, and the nozzles 15. This ink passage member 81 in which the ink chambers 17 and the nozzles 15 are integrally formed can be produced through an electroforming process. In this embodiment, also, the width of each of the ink chambers 17 is varied in a manner that the width becomes smaller as the distance from each actuatable piezoelectric element 7 is greater.

The above-described embodiments of the present invention can be applied to not only an ink jet printing head using the deformation in directions perpendicular to the direction of the electric field applied to the piezoelectric elements, but also an ink jet printing head using the deformation in directions parallel to the direction of the electric field applied to the piezoelectric elements.

Next, a description will be given of a method of manufacturing an ink jet printing head in one embodiment of the present invention.

As described above, the ink jet printing head in this embodiment comprises: a plurality of piezoelectric actuators arranged in rows on an insulating substrate, each row including actuatable piezoelectric elements and fixing piezoelectric elements which are alternately arrayed along the row, the actuatable piezoelectric elements being actuatable to apply a compressive force to ink in accordance with print signals; and an ink chamber unit which includes ink chambers located above the respective actuatable piezoelectric elements and the respective ink chambers containing ink. This ink jet printing head forces out ink drops from the nozzles of the ink chamber unit in accordance with the print signals by mechanically pressurizing the ink through the actuation of the piezoelectric elements.

As described above in conjunction with FIGS. 20 through 22, the method of manufacturing the ink jet printing head includes the steps of: forming a pattern of electrodes on the substrate 3; bonding the piezoelectric actuator units 63 to the substrate 3 by using an adhesive agent; forming the actuator unit 1, including the individual piezoelectric elements 64, the individual drive electrodes 61, and the common electrodes 62, by cutting or grooving the piezoelectric actuator units 63 and the pattern of the electrodes on the substrate 3; forming the ink chamber unit 2 which includes: the oscillation plate 12 including the diaphragm portions connected to the respective piezoelectric elements 7 and independently deformable in the laminating direction perpendicular to the substrate 3 by the piezoelectric elements 7 when actuated; the nozzle plate 16 which includes the nozzles 15 located above the respective diaphragm portions and opened to the ink chambers; the ink passage member, arranged between the oscillation plate 12 and the nozzle plate 16, which includes the ink passages communicating with the respective ink chambers; and the fixing member which is arranged between the ink chamber unit 2 and the substrate 3 to encircle the piezoelectric actuators, the fixing member supporting the portions of the oscillation plate 12, other than the diaphragm portions, on the substrate 3; and bonding the ink chamber unit 2 to the actuator unit 1 by using an adhesive agent.

Figure 37:
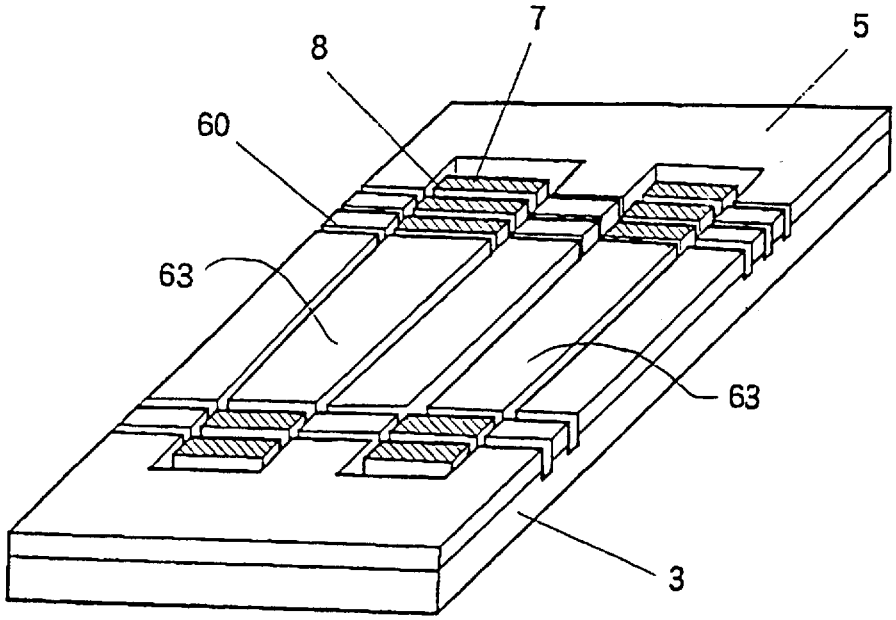
FIGS. 37 and 38 are diagrams for explaining fabricating procedures for piezoelectric actuators of the ink jet printing head in other embodiments of the present invention.
Figure 38:
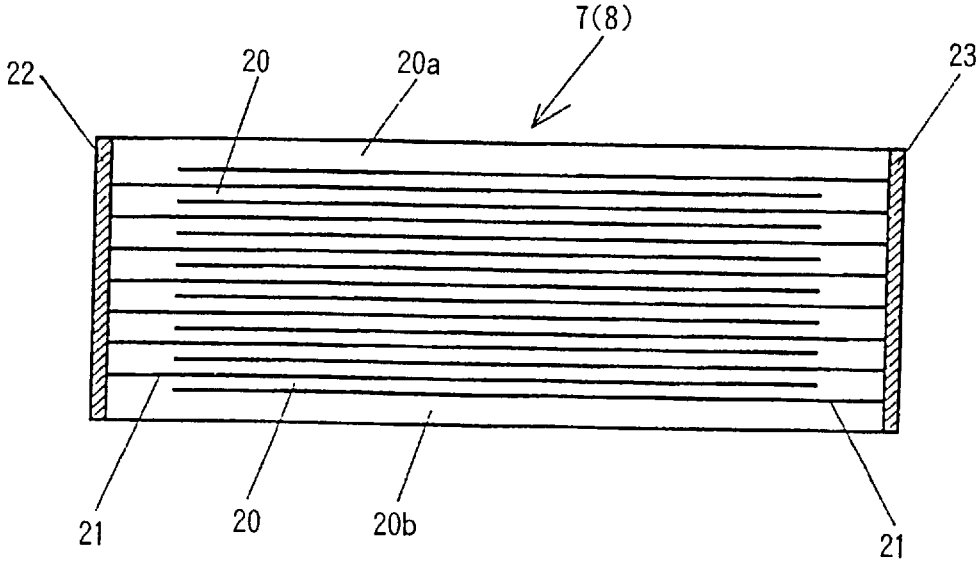

FIGS. 37 and 38 show the fabricating procedures for piezoelectric actuators of the ink jet printing head in other embodiments of the present invention.

In FIG. 37, the two, multilayer-structure piezoelectric actuator units 63 are bonded to the substrate 3, and the frame 5 is bonded to the substrate 3. The top surfaces of the piezoelectric actuator units 63 and the top surface of the frame 5 are ground so that they are matched at the same height. The piezoelectric actuator units 63 and the frame 5 are cut or grooved at one time by using a suitable cutting machine, so that the transversely extending grooves 60 are formed.

By this forming method, it is possible to prevent the piezoelectric actuators arranged in rows, each row including the actuatable piezoelectric elements 7 and the fixing piezoelectric elements 8, from slanting with respect to the direction at right angles to the line of each row. Also, as the pattern of the electrodes on the substrate 3 is held by the frame 5, it is possible to prevent the pattern of the electrodes from being separated from the substrate 3 during the forming procedures.

In FIG. 38, the actuatable piezoelectric element 7 (or the fixing piezoelectric element 8) of the piezoelectric actuator units includes internal piezoelectric portions 20, outermost piezoelectric portions 20*a* and 20*b*, and internal electrode portions 21. As shown in FIG. 38, the thickness of each of the outermost piezoelectric portions 20*a* and 20*b* is greater than the thickness of each internal piezoelectric portion 20. Thus, when grinding the top surfaces of the piezoelectric actuator units 63 and the top surface of the frame 5 to match them at the same height, it is possible to prevent the internal electrode portions 21 from being exposed to the outside when the quantity of the outermost piezoelectric material being ground is increased to ensure accurate surface flatness of the ground surfaces.

The outermost piezoelectric portions 20*a* and 20*b* are not connected to the internal electrode portions 21, and not deformable when the actuatable piezoelectric elements 7 are actuated in accordance with the print signals. Thus, even if the thickness of the outermost piezoelectric portions 20*a* and 20*b* is increased, the piezoelectric characteristic of the piezoelectric actuators 4 is not influenced.

Further, the present invention is not limited to the above described embodiments, and variations and modifications may be made without departing from the scope of the present invention.

What is claimed is:

1. An ink jet printing head comprising:

a plurality of piezoelectric actuators arranged in rows, aligned substantially in a line, on a substrate, each row including first piezoelectric elements and second piezoelectric elements which are alternately arrayed along the row, the first piezoelectric elements being actuatable to apply a compressive force on ink in accordance with print signals, the second piezoelectric elements being fixed and not actuated;

said first and second piezoelectric elements having substantially the same width in the directions of said rows, and said first and second piezoelectric elements having a multilayer structure including laminated layers; and an ink chamber unit, arranged on said actuators, which includes ink chambers located above the respective first piezoelectric elements, the respective ink chambers containing ink, said ink chamber unit comprising:

an oscillation plate including diaphragm portions which are connected to the respective first piezoelectric elements and independently deformable in a vertical direction perpendicular to the substrate by said first piezoelectric elements when actuated; and a nozzle plate which includes nozzles located above the respective diaphragm portions and opened to the ink chambers, so that ink drops are respectively forced out from the nozzles when the first piezoelectric elements are actuated, wherein said nozzles are provided separately from said oscillation plate.

2. The ink jet printing head according to claim 1, wherein said first piezoelectric elements and said second piezoelectric elements are formed at one time by cutting a multilayer piezoelectric material.

3. The ink jet printing head according to claim 1, wherein said oscillation plate of said ink chamber unit is made of a metal sheet.

4. The ink jet printing head according to claim 1, wherein said oscillation plate of said ink chamber unit is made of a resin sheet with a moisture permeability, sufficiently low enough to prevent ink leakage.

5. The ink jet printing head according to claim 1, wherein the second piezoelectric elements respectively fix portions of the oscillation plate of the ink chamber unit, other than the diaphragm portions, to the substrate.

6. An ink jet printing head comprising:

a plurality of piezoelectric actuators arranged in rows, aligned substantially along a line, on a substrate, each row including first piezoelectric elements and second piezoelectric elements which are alternately arrayed along the row, the first piezoelectric elements being actuatable to apply a compressive force on ink in accordance with print signals, the second piezoelectric elements being fixed and not actuated;

said first and second piezoelectric elements having substantially the same width in the direction of said rows, and said first and second piezoelectric elements having a multilayer structure including laminated layers; and an ink chamber unit, arranged on said actuators, which includes ink chambers located above the respective first piezoelectric elements, wherein the respective ink chambers contain ink, said ink chamber unit comprising:

an oscillation plate including diaphragm portions which are connected to the respective first piezoelectric elements thereby forming connections between said diaphragm portions and said first piezoelectric elements and said diaphragm portions being independently deformable in a vertical direction perpendicular to the substrate by said first piezoelectric elements when actuated;

a nozzle plate which includes nozzles located above the respective diaphragm portions and opened to the ink chambers, so that ink drops are respectively forced out from the nozzles when the first piezoelectric elements are actuated, wherein said nozzles are provided separately from said oscillation plate; and an ink passage member, arranged between said oscillation plate and said nozzle plate, which includes ink passages communicating with the respective ink chambers, said ink passages having a shape corresponding to a shape of said diaphragm portions.

7. The ink jet printing head according to claim 6, wherein each first piezoelectric element has layers which are laminated in the direction perpendicular to said substrate, to form a multilayer piezoelectric actuator, and each second piezoelectric element has layers which are laminated in said perpendicular direction to form a multilayer piezoelectric actuator.

8. The ink jet printing head according to claim 6, wherein each of the diaphragm portions of the oscillation plate comprises a first portion and a second portion which have different thicknesses, said first portions having a greatest thickness in the oscillation plate and being connected to the first piezoelectric elements, said second portions encircling the first portions and having a smallest thickness in the oscillation plate.

9. The ink jet printing head according to claim 6, wherein said nozzle plate and said oscillation plate are both made of a metal material.

10. The ink jet printing head according to claim 6, wherein said nozzle plate is formed by a forming process, and said oscillation plate is formed by the same said forming process.

11. The ink jet printing heat according to claim 6, wherein said nozzle plate includes first and second end portions, and alignment marks at said end portions thereof, and said oscillation plate includes alignment marks at locations thereof which correspond to the end portions of the nozzle plate.

12. The ink jet printing head according to claim 6, further comprising a fixing member which is arranged between the ink chamber unit and the substrate to encircle the piezoelectric actuators, said fixing member correcting portions of the oscillation plate of the ink chamber unit, other than the diaphragm portions, to the substrate.

13. The ink jet printing head according to claim 12, wherein said fixing member is made of a sheet material extending along either or both of the piezoelectric actuator rows and being arranged between the ink chamber unit and the substrate.

14. The ink jet printing head according to claim 6, wherein said ink chamber unit further comprises fixing portions which are connected to the respective second piezoelectric elements thereby forming connections between said fixing portions and said second piezoelectric elements, and wherein a cross-sectional area of each of said connections between said second piezoelectric elements and said fixing portions of said ink chamber unit is greater than an area of each of said connections between said first piezoelectric elements and said diaphragm portions.

15. The ink jet printing head according to claim 13, wherein said first piezoelectric elements, said second piezoelectric elements, and said fixing member are made of ceramic materials.

16. The ink jet printing head according to claim 12, wherein said fixing member is made of a resin sheet containing a filler said filler reducing the thermal expansivity of said resin.

17. The ink jet printing head according to claim 6, wherein the ink chambers of the ink chamber unit are transversely elongated with respect to the line of each row of the piezoelectric actuators.

18. The ink jet printing head according to claim 6, wherein said ink chamber unit further includes common ink chambers which are provided on both sides of the ink chambers and communicate with the ink chambers, so that ink is supplied to the ink chambers via the common ink chambers.

19. The ink jet printing head according to claim 18, wherein said ink chamber unit further includes fluid resistance portions which communicate with the respective ink chambers, said common ink chambers communicating with the fluid resistance portions.

20. The ink jet printing head according to claim 19, wherein said ink chambers, said common ink chambers, and said fluid resistance portions are located symmetrically about each row of the piezoelectric actuators.

21. The ink jet printing head according to claim 6, wherein said ink chamber unit further includes common ink chambers which are provided on both sides of the ink chambers and communicate with the respective ink chambers, and the common ink chambers are located symmetrically about each row of the piezoelectric actuators.

22. The ink jet printing head according to claim 21, wherein said common ink chambers on the both sides of the ink chambers included in the ink chamber unit have the same shape and are symmetrically arranged about each row of the piezoelectric actuators.

23. The ink jet printing head according to claim 6, wherein each of the ink chambers included in the ink chamber unit is transversely elongated with respect to the line of each row of the piezoelectric actuators, and a first width of each ink chamber in a transverse direction is greater than twice a second width of the ink chamber in a direction at right angles to the transverse direction.

24. The ink jet printing head according to claim 6, wherein said piezoelectric actuators are arranged in two rows on the substrate, and the first and second piezoelectric elements of the two rows are arranged in a zigzag manner.

25. The ink jet printing head according to claim 14, wherein said fixing portions of said ink chamber unit comprises stationary portions of said oscillation plate, and wherein the second piezoelectric elements respectively fix said portions of the oscillation plate of the ink chamber unit to the substrate, and wherein a width of each second piezoelectric element along the line of each row of the piezoelectric actuators is greater than a width of each of said stationary portions of the oscillation plate.

26. The ink jet printing head according to claim 25, wherein a width of each ink chamber along the line of each row of the piezoelectric actuators is greater than a width of each diaphragm portion of the oscillation plate.

27. The ink jet printing head according to claim 25, wherein a width of each second piezoelectric element along the line of each row of the piezoelectric actuators is greater than a width of each first piezoelectric element.

28. The ink jet printing head according to claim 25, wherein each of the diaphragm portions of the oscillation plate comprises a first portion and a second portion which have different thicknesses, said first portions having a greatest thickness in the oscillation plate and being connected to the first piezoelectric elements, said second portions encircling the first portions and having a smallest thickness in the oscillation plate.

29. The ink jet printing head according to claim 18, wherein a width of each ink chamber in a transverse direction to the line of each row of the piezoelectric actuators is varied in a manner that said width adjacent to oscillation plate is wider than said width adjacent to nozzle of the ink chamber.

30. The ink jet printing head according to claim 18, wherein a width of each ink chamber in a longitudinal direction along the line of each row of the piezoelectric actuators is varied in a manner that said width adjacent to oscillation plate is wider than said width adjacent to nozzle of the ink chamber.

* * * * *